US007643774B2

(12) United States Patent
Choi

(10) Patent No.: US 7,643,774 B2
(45) Date of Patent: Jan. 5, 2010

(54) ROLLER SPACING APPARATUS AND IMAGE FORMING DEVICE HAVING THE SAME

(75) Inventor: Dong-hyuk Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 464 days.

(21) Appl. No.: 11/550,848

(22) Filed: Oct. 19, 2006

(65) Prior Publication Data

US 2007/0147896 A1 Jun. 28, 2007

(30) Foreign Application Priority Data

Dec. 28, 2005 (KR) ..... 10-2005-0131955

(51) Int. Cl.

| | |
|---|---|
| ***G03G 15/00*** | (2006.01) |
| ***G03G 21/16*** | (2006.01) |
| ***G03G 15/02*** | (2006.01) |
| ***G03G 15/04*** | (2006.01) |
| ***G03G 15/06*** | (2006.01) |
| ***G03G 15/08*** | (2006.01) |
| ***G03G 21/18*** | (2006.01) |

(52) U.S. Cl. ..... 399/126; 399/115; 399/116; 399/119; 399/159; 399/222; 399/279

(58) Field of Classification Search ..... 399/111, 399/113, 115–117, 119, 126, 159, 222, 279, 399/176, 265, 313

See application file for complete search history.

(56) References Cited

U.S. PATENT DOCUMENTS 6,134,395 A * 10/2000 Sasaki et al. ..... 399/46

(Continued)

FOREIGN PATENT DOCUMENTS

CN 2488082 4/2002

(Continued)

OTHER PUBLICATIONS

Chinese Office Action dated Jul. 4, 2008 issued in CN2006101514205.

*Primary Examiner*—David M Gray
*Assistant Examiner*—Joseph S Wong
(74) *Attorney, Agent, or Firm*—Stanzione & Kim LLP

(57) ABSTRACT

A roller spacing apparatus and an image forming device including the same. The roller spacing apparatus includes a frame, a first rotatable roller member having a first shaft, a second rotatable roller member having a second shaft and being rotatable in a close contact with the first roller member under a predetermined pressure, and at least one spacing part to space apart the first and the second roller members from each other by a predetermined gap such that the first and the second roller members are not in contact with each other when the first and the second roller members are not in use. The at least one spacing part includes a bushing member that has a bushing to rotatably support one of the first and second shafts on the frame, and a lever positioned at the bushing to rotate the bushing, the bushing having an outer diameter part and an inner diameter part to support the one of the first and second shafts, the inner and outer diameter parts being non-concentric circles such that a center point of the inner diameter part is at a different location from a center point of the outer diameter part, a stopping member disposed on the frame to restrict an operation range of the bushing, and a power transmitting member to selectively transmit an external rotation force to the bushing such that the bushing rotates in a direction.

28 Claims, 11 Drawing Sheets

U.S. PATENT DOCUMENTS

| | | | | |
|---|---|---|---|---|
| 2002/0071693 | A1* | 6/2002 | Shimaoka | 399/113 |
| 2004/0013448 | A1* | 1/2004 | Lee | 399/159 |
| 2005/0185989 | A1* | 8/2005 | Kosuge et al. | 399/168 |
| 2007/0053708 | A1* | 3/2007 | Mori et al. | 399/69 |

FOREIGN PATENT DOCUMENTS

| | | |
|---|---|---|
| CN | 1469208 | 1/2004 |
| CN | 1577159 | 2/2005 |
| JP | 08-185047 | 7/1996 |
| JP | 11-15239 | 1/1999 |
| JP | 2003-337472 | 11/2003 |
| KR | 1999-28897 | 7/1999 |

* cited by examiner

ROLLER SPACING APPARATUS AND IMAGE FORMING DEVICE HAVING THE SAME

CROSS-REFERENCE TO RELATED APPLICATIONS

This application claims the benefit under 35 U.S.C. §119 of Korean Patent Application No. 2005-131955, filed on Dec. 28, 2005, in the Korean Intellectual Property Office, the entire content of which is incorporated herein by reference.

BACKGROUND OF THE INVENTION

1. Field of the Invention

The present general inventive concept relates to an electrophotographic image forming device, such as a laser printer, a digital photocopier, or a facsimile machine. More particularly, the present general inventive concept relates to a roller spacing apparatus to space apart two rollers (e.g., a photoconductive medium and a developing roller, or a photoconductive medium and a charging roller) that rotate in close contact with each other under a predetermined pressure by a predetermined distance, and to maintain the two rollers in a non-contact state when the two rollers are not in use (e.g., during shipping), and an image forming device having the roller spacing apparatus.

2. Description of the Related Art

Generally, an electrophotographic image forming device, such as a laser printer, a digital photocopier, or a facsimile machine includes a photoconductive medium (e.g., a photoconductive drum) to form a developer image.

A charging roller, a laser scanning unit (LSU), and a developing roller are disposed at predetermined locations around an outer circumference of the photoconductive medium along a rotational direction. The charging roller charges a surface of the photoconductive medium to a predetermined electric potential, the LSU scans the surface of the charged photoconductive medium with laser beams and thereby forms an electrostatic latent image on the surface of the photoconductive medium, and the developing roller supplies a developer to the surface of the photoconductive medium and thereby forms the developer image corresponding to the electrostatic latent image.

The developing roller and the charging roller are rotated in close contact with the photoconductive medium under a predetermined pressure. The photoconductive medium, the developing roller, and/or the charging roller include an elastic layer, such as a rubber layer, to provide protection from a contact damage.

The image forming device maintains the photoconductive medium and the charging roller and/or the developing roller with the elastic layer in close contact until the image forming device is delivered to a user. As a result, the elastic layer is physically and permanently compression set, or is chemically changed to cause high viscosity low molecular organic matter of the elastic layer to come out from a surface of the elastic layer. The high viscosity low molecular organic matter is combined with the developer and adheres to the surface of the photoconductive medium. In this case, physical and chemical changes may cause device components to malfunction and may cause image degradation. As a result, a reliability of the device may deteriorate. In some cases, a deformed roller, or even the image forming device itself, has to be replaced.

The photoconductive medium, the charging roller, and the developing roller are fabricated as a process cartridge that integrates components into a housing as a single module unit, so that the components are easily detachable from a body of the electrophotographic image forming device for easy repair or replacement.

If the process cartridge fabricated for replacement is not in use (e.g., after being purchased by a user, but before being mounted in the body of the image forming device), the photoconductive medium and the charging roller and/or the developing roller are typically in close contact with each other during the period of non-use. Accordingly, there is a problem that the elastic layer of the photoconductive medium, the developing roller, and/or the charging roller may be physically or chemically damaged.

In an effort to address this problem, the image forming device or the process cartridge includes an apparatus for spacing apart the charging roller or the developing roller from the photoconductive medium when not in use (i.e., in the period of non-use).

FIGS. 1 to 3 are views illustrating a conventional roller spacing apparatus 1, which spaces a developing roller 20 from a photoconductive medium 10 when an image forming device is not in use.

Referring to FIGS. 1 to 3, the roller spacing apparatus 1 includes a spacing member 30 disposed at a shaft 21 of a developing roller 20 (i.e., the developing roller shaft 21), and the spacing member 30 is movable between a first position and a second position. As illustrated in FIG. 2, if the spacing member 30 is at the first position (in a contact state), the developing roller 20 is not spaced apart from the photoconductive medium 10. As illustrated in FIG. 3, if the spacing member 30 is at the second position (in a non-contact state), the developing roller 20 is spaced apart from the photoconductive medium 10 by a predetermined gap "g."

The spacing member 30 includes a spacing protrusion 35 that is brought into contact with a stepped portion 12 of a driving gear 11 of the photoconductive medium 10 when the spacing member 30 is at the second position (FIG. 3), and spaces apart the developing roller 20 from the photoconductive medium 10 by the predetermined gap "g."

The spacing member 30 is movable between the first and the second positions along the shaft 21 of the developing roller 20 by a spacing member moving part 40.

The spacing member moving part 40 includes a first rotary member 41 and a second rotary member 42. The first rotary member 41 is idly rotatable around the developing roller shaft 21 and the second rotary member 42 is rotatable integrally with the developing roller shaft 21 at a D-cut portion 22 of the developing roller shaft 21. The first and the second rotary members 41 and 42 are restricted by fixing members 48 and 47, respectively, so that the first and the second rotary members 41 and 42 do not move in a lengthwise direction of the developing roller shaft 21.

As illustrated in FIG. 3, the roller spacing apparatus 1 has a rotary knob 50 into which the D-cut portion 22 of the developing roller shaft 21 is inserted to rotate the second rotary member 42. When the developing roller shaft 21 is rotated after being inserted into the rotary knob 50, the developing roller shaft 21 and the second rotary member 42 are rotated in the same direction. The first rotary member 41 is rotated according to a rotational movement of the photoconductive medium 10 when the image forming device operates.

An operation of the conventional roller spacing apparatus 1 will now be described.

The rotary knob 50 is rotated in one direction (i.e., in a counter clockwise direction) after being combined with the shaft 21 of the developing roller 20 of the image forming device or a process cartridge, which has passed a printing test of an image quality test.

As the rotary knob 50 is rotated, the second rotary member 42 and the developing roller shaft 21 are rotated together with the rotary knob 50 in the counter clockwise direction. At this time, a third rotary projection 45 and a fourth rotary projection 46 of the second rotary member 42 are rotated along a second inclination surface 36 of the spacing member 30, thereby moving the spacing member 30 to the second position of the developing roller shaft 21.

As illustrated in FIG. 3, the spacing protrusion 35 of the spacing member 30 is brought into contact with the stepped portion 12 of the driving gear 11 of the photoconductive medium 10 due to the movement of the spacing member 30 such that the developing roller 20 is spaced apart from the photoconductive medium 10 by a distance that can be as much as a height of the spacing protrusion 35.

Accordingly, the conventional roller spacing apparatus 1 is intended to space the developing roller 20 form the photoconductive medium 10 when the image forming device or the process cartridge is placed on the market. The developing roller 20 and the photoconductive medium 10 are intended to remain spaced apart from one another until the image forming device or the process cartridge is delivered to a user.

When the image forming device or the process cartridge performs a printing operation, the first rotary member 41 is rotated in the counter clockwise direction by a driving force transmitted from a main driving device of the image forming device to the first rotary member 41 through the driving gear 11 of the photoconductive medium 10. At this time, a first rotary projection 43, which is lockable into a first locking portion 31 of the spacing member 30, and a second rotary projection 44, which is lockable into a second locking portion 32 of the spacing member 30, are rotated along a first inclination surface 37 of the spacing member 30, thereby moving the spacing member 30 from the second position of the developing roller shaft 21 to the first position (i.e., the contact state).

This occurs when the spacing protrusion 35 is removed from the stepped portion 12 of the driving gear 11 of the photoconductive medium 10 by the movement of the spacing member 30, and as a result, the developing roller 20 is brought into contact with the photoconductive medium 10.

During this process, the second rotary member 42 and the developing roller 20 are not initially rotated because the third and the fourth rotary projections 45 and 46 of the second rotary member 42 are not locked into a third locking portion 33 and a fourth locking portion 34, respectively, until the spacing member 30 is rotated by 180°.

Once the developing roller 20 is moved into the contact state of the first position, when the first rotary member 41 is rotated at least one time, the spacing member 30 is rotated by more than 1800. Accordingly, the third and the fourth rotary projections 45 and 46 of the second rotary member 42 are respectively locked into the third and the fourth locking projections 33 and 34 of the spacing member 30. As a result, the rotational force of the first rotary member 41 is transmitted to the second rotary member 42, and the developing roller 20 is rotated along with the second rotary member 42 in the counter clockwise direction. That is, the photoconductive medium 10 and the developing roller 20 are rotated in close contact with each other and perform a developing operation.

As illustrated in FIG. 2, when the main driving device of the image forming device stops performing a driving operation, the first and the second rotary projections 43 and 44 of the first rotary member 41, the third and the fourth rotary projections 45 and 46 of the second rotary member 42, and the spacing protrusion 35 of the spacing member 30 that interact with the aforementioned corresponding elements, maintain the contact state as long as the user does not forcibly-rotate the shaft 21 of the developing roller 20 by using the rotary knob 50.

However, the conventional roller spacing apparatus 1 has the spacing member 30 and the first and the second rotary members 41 and 42 located at a first end portion of the shaft 21 of the developing roller 20 to space out the developing roller 20 from the photoconductive medium 10.

Accordingly, in operation, only the first end portion of the developing roller 20 is spaced away from the photoconductive medium 10 by a distance of as much as the height of the spacing protrusion 35. However, a second end portion of the developing roller 20 opposite from the first end portion is not spaced apart from the photoconductive medium 10 by a distance of as much as the height of the spacing protrusion 35, and the second end portion of the developing roller 20 remains in the contact state with the photoconductive medium 10. As a result, an elastic layer formed on the second end portion of the developing roller 20 or on a corresponding portion of the photoconductive medium 10 is physically and permanently compression set. Otherwise, high viscosity low molecular organic matter that comes out of the elastic layer of the developing roller 20 or the photoconductive medium 10 is combined with a developer, and thus is fixed to a surface of the developing roller 20 and/or the photoconductive medium 10.

Since the conventional roller spacing apparatus 1 has no element to guide or restrict the movement of the spacing protrusion 35, which spaces out the developing roller 20 from the photoconductive medium 10, it is difficult to set the spacing protrusion 35 of the spacing member 30 above the driving gear 11 of the photoconductive medium 10. Also, when the image forming device or the process cartridge is delivered, the spacing protrusion 35 changes position, and thus a motion stability of the spacing member 30 cannot be obtained. In other words, the spacing member 30 does not remain in a predetermined position when the roller spacing apparatus 1 is moved.

SUMMARY OF THE INVENTION

The present general inventive concept provides a roller spacing apparatus that prevents elastic layers of two rollers (e.g., a photoconductive medium and a developing roller, or a photoconductive medium and a charging roller), which rotate in close contact with each other under a predetermined pressure, from being physically and permanently compression set as a result of maintaining the two rollers in a contact state or a partial contact state when the two rollers are not in use, and an image forming device having the same.

Additional aspects of the present general inventive concept will be set forth in part in the description which follows and, in part, will be obvious from the description, or may be learned by practice of the general inventive concept.

The foregoing and/or other aspects and utilities of the present general inventive concept are achieved by providing a roller spacing apparatus of an image forming device, the apparatus including a frame, a first rotatable roller member having a first shaft, a second rotatable roller member having a second shaft and being rotatable in close contact with the first roller member under a predetermined pressure, and at least one spacing part to space the first and the second roller members apart from each other by a predetermined gap such that the first and the second roller members are not in contact with each other when the first and the second roller members are not in use. The at least one spacing part includes a bushing member that has a bushing to rotatably support a first one of the first and second shafts on the frame, and a lever positioned at the bushing to rotate the bushing, and the bushing has an outer diameter part and an inner diameter part to support the first one of the first and second shafts, the inner and outer diameter parts being non-concentric circles such that a center point of the inner diameter part is at a different location from a center point of the outer diameter part, a stopping member disposed on the frame to restrict an operation range of the bushing, and a power transmitting member to selectively transmit an external rotation force to the bushing such that the bushing rotates in a direction.

The at least one spacing part may further include a first spacing part to space apart first ends of the first and second shafts from each other by the predetermined gap, and a second spacing part to space apart second ends of the first and second shafts from each other by the predetermined gap.

The stopping member may include a first stopping protrusion disposed on the frame to restrict a first directional movement of the lever, and a second stopping protrusion disposed on the frame to restrict a second directional movement of the lever opposite to the first directional movement.

The power transmitting member may include a power transmitting gear formed at a second one of the first and second shafts to be rotated by an external driving force, a rotary gear formed integrally with the bushing at the first one of the first and second shafts to be rotatable in combination with the bushing, and an idle gear having a partial tooth part that selectively transmits a rotation force of a first one of the power transmitting gear and the rotary gear to a second one of the power transmitting gear and the rotary gear when the first one of the power transmitting gear and the rotary gear rotates. The partial tooth part may be formed such that the rotation force of the first one of the power transmitting gear and the rotary gear is transmitted within the operation range of the bushing restricted by the stopping member to the second one of the power transmitting gear and the rotary gear.

The at least one spacing part may further include a position holding member to hold the lever such that the bushing is in a first position to bring the first and the second roller members into contact with each other or a second position to space the first and the second roller members apart from each other by the predetermined gap.

The position holding member may include a position holding protrusion disposed on the frame between the first and the second stopping protrusions of the stopping member, the position holding protrusion being elastically movable between an up position, in which the position protrusion is located within a moving path of the lever, and a down position, in which the position holding protrusion is located outside of the moving path of the lever. The position holding protrusion may be elastically movable by an external force applied to the position holding protrusion, or by the lever.

The first roller member may include a photoconductive medium to have an electrostatic latent image formed thereon, and the second roller member may include a developing roller to develop the electrostatic latent image.

The first roller member may include a photoconductive medium to have an electrostatic latent image formed thereon, and the second roller member may include a charging roller to charge the photoconductive medium with a predetermined electric potential.

The first roller member may include a photoconductive medium to have an electrostatic latent image formed thereon, and the second roller member may include a transfer roller to transfer a developer image from the photoconductive medium to a print medium or to an intermediate transfer medium.

The foregoing and/or other aspects and utilities of the present general inventive concept are also achieved by providing a spacing apparatus usable in an image forming device including first and second rollers having first and second shafts, respectively, a first spacing part disposed on a frame at first ends of the first and second shafts to space first ends of the first and second rollers apart, and a second spacing part disposed on the frame at second ends of the first and second shafts to space second ends of the first and second rollers apart.

The foregoing and/or other aspects and utilities of the present general inventive concept are also achieved by providing a spacing apparatus usable with an image forming device, including a frame having first and second rollers extending therebetween, and a lever rotatably disposed on an outer portion of the frame between a first position and a second position and being connected to one of the first and second rollers such that when the lever is rotated to the first position the first and second rollers are spaced apart from each other and when the lever is rotated to the second position the first and second rollers contact each other.

The foregoing and/or other aspects and utilities of the present general inventive concept are also achieved by providing a spacing apparatus usable with an image forming device, including a frame having first and second rollers extending therebetween, first and second gears disposed on ends of the first and second rollers, an idle gear having teeth on a part of a circumference thereof such that when one of the first and second rollers is rotated by the corresponding gear, an arrangement of the teeth of the idle gear is changed with respect to the first and second gears to move the first and second rollers with respect to each other.

The foregoing and/or other aspects and utilities of the present general inventive concept are also achieved by providing an image forming device, including a body having a frame and at least one driving motor located on the frame, and a process cartridge. The process cartridge includes a first rotatable roller member having a first shaft, a second rotatable roller member that is rotatable in close contact with the first roller member under a predetermined pressure and having a second shaft, at least one spacing part to space the first and the second roller members apart from each other by a predetermined gap such that the first and the second roller members are not in contact with each other when the first and the second roller members are not in use, and a housing being detachably mounted on the frame to integrate the first and the second roller members with the at least one spacing part. The at least one spacing part includes a bushing member having at least one bushing and at least one lever positioned at the at least one bushing to rotate the at least one bushing, the at least one bushing being rotatably disposed in the housing to rotatably support a first one of the first and second shafts, and the at least one bushing has an inner diameter part to support the first one of the first and second shafts and an outer diameter part, the inner and outer diameter parts being non-concentric circles such that a center point of the inner diameter part is at a different location from a center point of the outer diameter part, a stopping member disposed on the housing to restrict an operation range of the at least one bushing, and a power transmitting member connected to the driving motor to selectively transmit a rotation force from the driving motor to the at least one bushing such that the at least one bushing rotates in a direction.

The at least one spacing part may include a first spacing part to space first end portions of the first and second shafts apart from each other by the predetermined gap, and a second spacing part to space second end portions of the first and second shafts apart from each other by the predetermined gap.

The housing may include a fixing hole, and the bushing member may further include at least one hook member to lock the at least one bushing onto one side edge of the fixing hole.

The stopping member may include a first stopping protrusion disposed on the housing to restrict a first directional movement of the lever, and a second stopping protrusion disposed on the housing to restrict a second directional movement of the lever opposite to the first directional movement.

The power transmitting member may include a power transmitting gear formed at a second one of the first and second shafts to be rotated by a driving force from the driving motor, a rotary gear formed integrally with the at least one bushing at the first one of the first and second shafts to be rotatable in combination with the at least one bushing, and an idle gear having a partial tooth part that selectively transmits a rotation force of a first one of the power transmitting gear and the rotary gear to a second one of the power transmitting gear and the rotary gear when the first one of the power transmitting gear and the rotary gear rotates. The partial tooth part may be formed such that the rotation force of the first one of the power transmitting gear and the rotary gear is transmitted within the operation range of the at least one bushing restricted by the stopping member to the second one of the power transmitting gear and the rotary gear.

The at least one spacing part may further include a position holding member disposed at the housing to hold the lever such that the at least one bushing is in a first position to bring the first and the second roller members into contact with each other or a second position to space the first and the second roller members apart from each other by the predetermined gap.

The position holding member may include a position holding protrusion disposed on the housing between the first and the second stopping protrusions of the stopping member, the position holding protrusion being elastically movable by an external force or by the lever between an up position, where the position holding protrusion is located within a moving path of the lever, and a down position, where the position holding protrusion is located outside of the moving path of the lever.

The first roller member may include a photoconductive medium to have an electrostatic latent image formed thereon, and the second roller member may include a developing roller to develop the electrostatic latent image.

The first roller member may include a photoconductive medium to have an electrostatic latent image formed thereon, and the second roller member may include a charging roller to charge the photoconductive medium with a predetermined electric potential.

The first roller member may include a photoconductive medium to have an electrostatic latent image formed thereon, and the second roller member may include a transfer roller to transfer a developer image from the photoconductive medium to a print medium or to an intermediate transfer medium.

The foregoing and/or other aspects and utilities of the present general inventive concept are also achieved by providing a process cartridge usable with an image forming device, the process cartridge including a frame, a first roller having a first shaft extending between sides of the frame, a second roller having a second shaft extending between the sides of the frame, and a spacing unit having a first spacing part disposed on the frame at first ends of the first and second shafts to space the first ends apart and a second spacing part disposed on the frame at second ends of the first and second shafts to space the second ends apart.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE EMBODIMENTS

Figure 1:
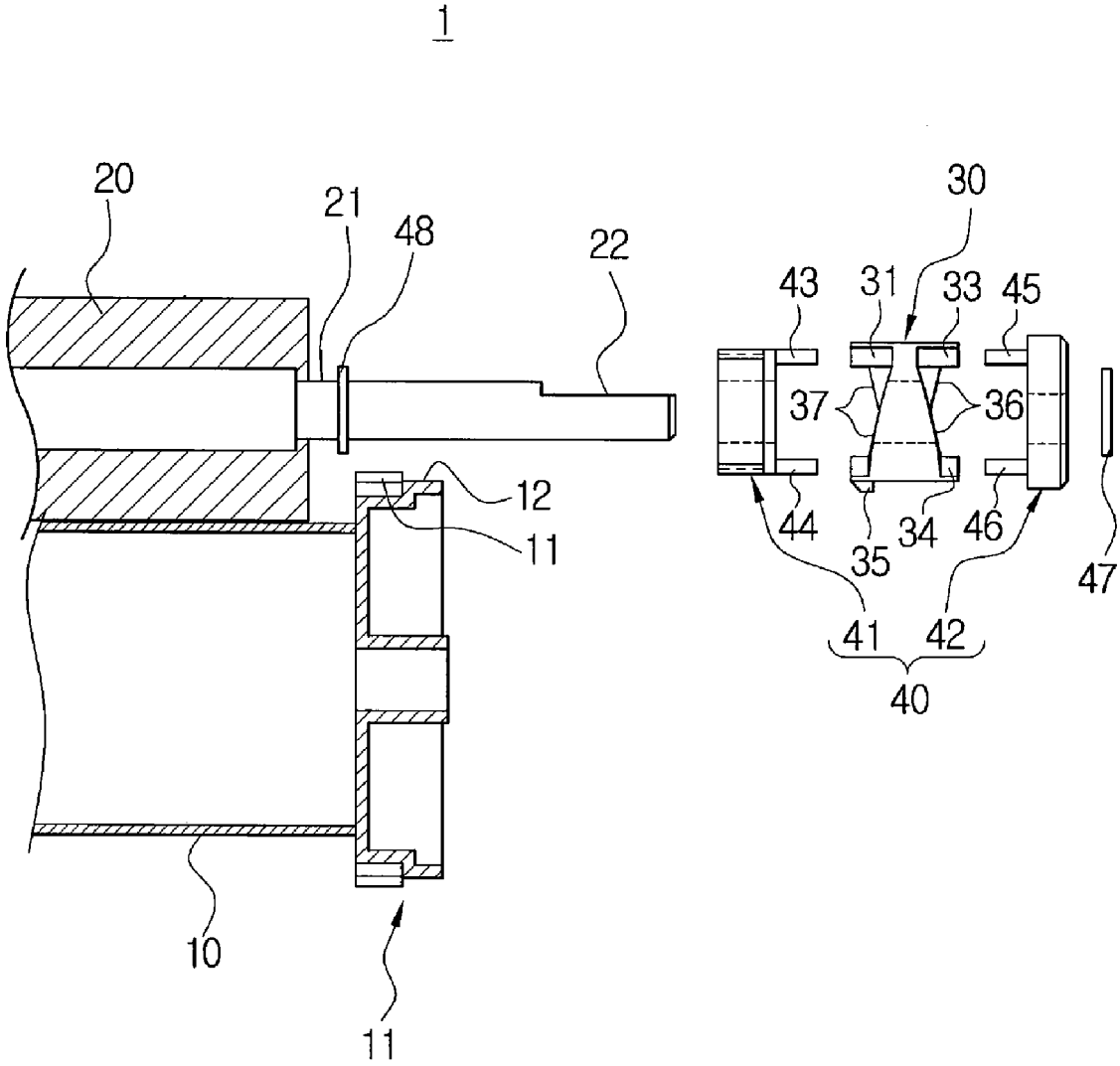
FIG. 1 (PRIOR ART)
FIG. 1 is an exploded cross section view illustrating a conventional roller spacing apparatus employed with a developing roller in an image forming device.
Figure 2:
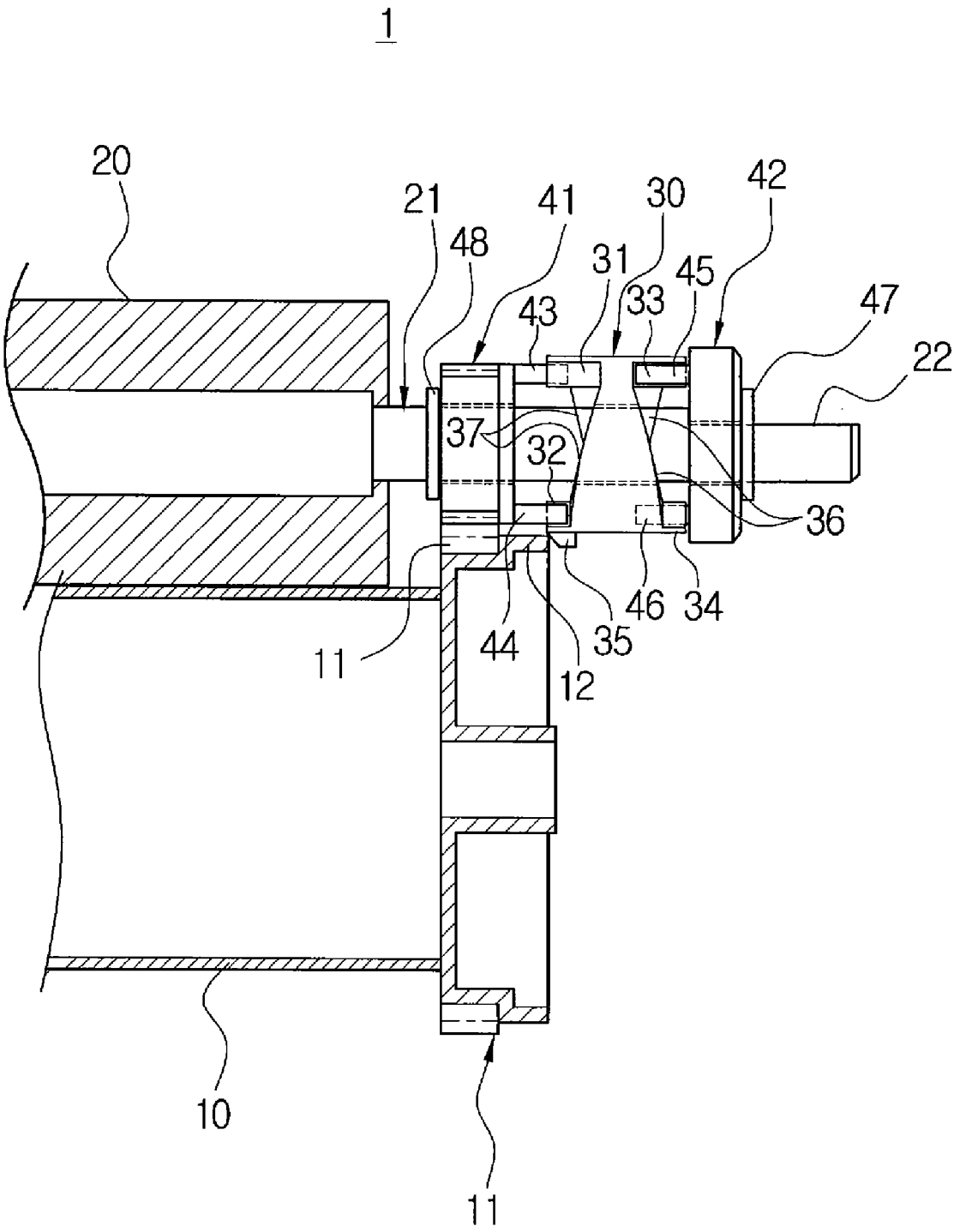
FIG. 2 (PRIOR ART)
FIG. 2 is an assembled cross section view illustrating the conventional roller spacing apparatus of FIG. 1 when a photoconductive medium and the developing roller are in close contact with each other.
Figure 3:
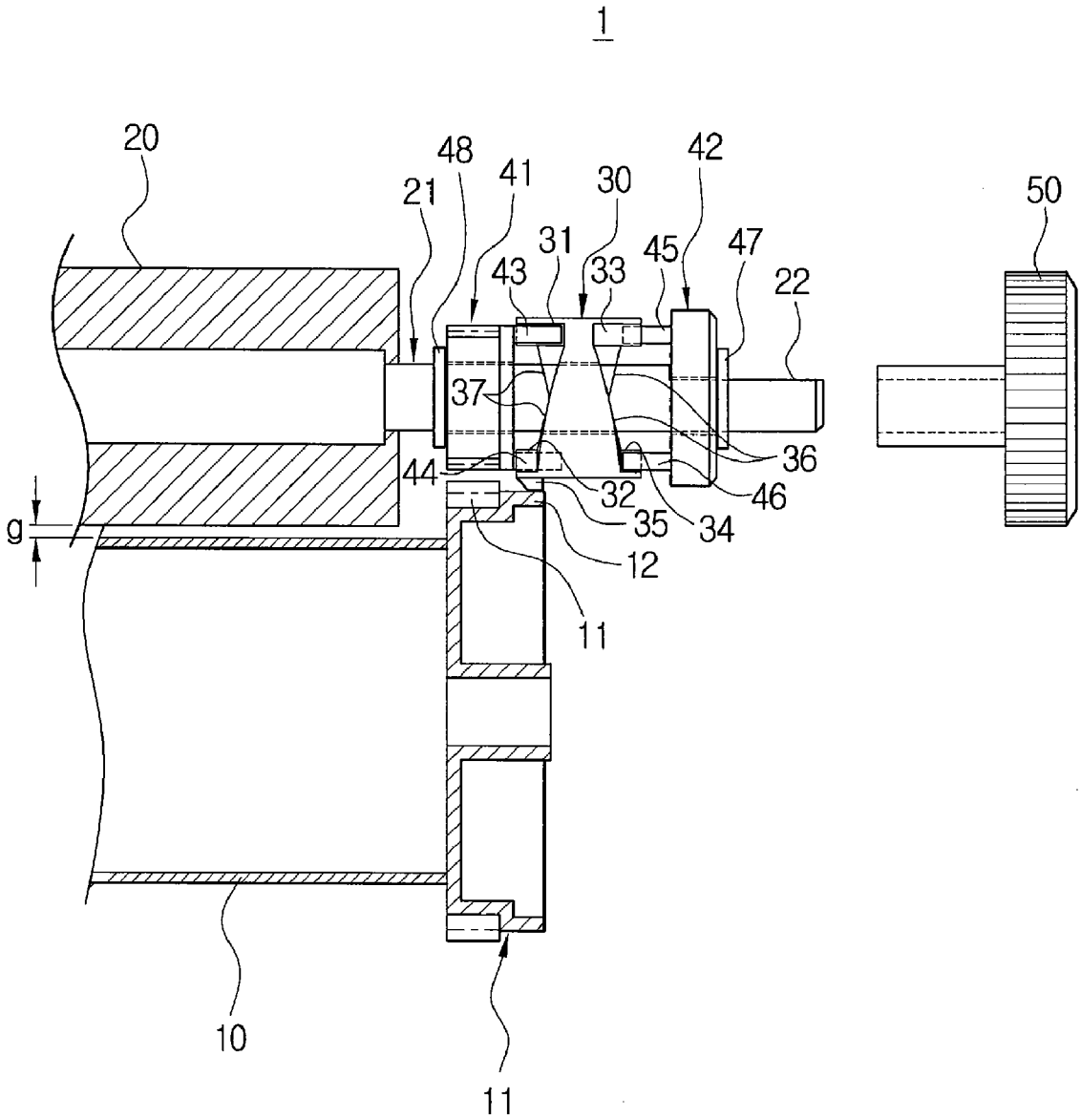
FIG. 3 (PRIOR ART)
FIG. 3 is an assembled cross section view illustrating the conventional roller spacing apparatus of FIG. 1 when the photoconductive medium and the developing roller are spaced apart from each other.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
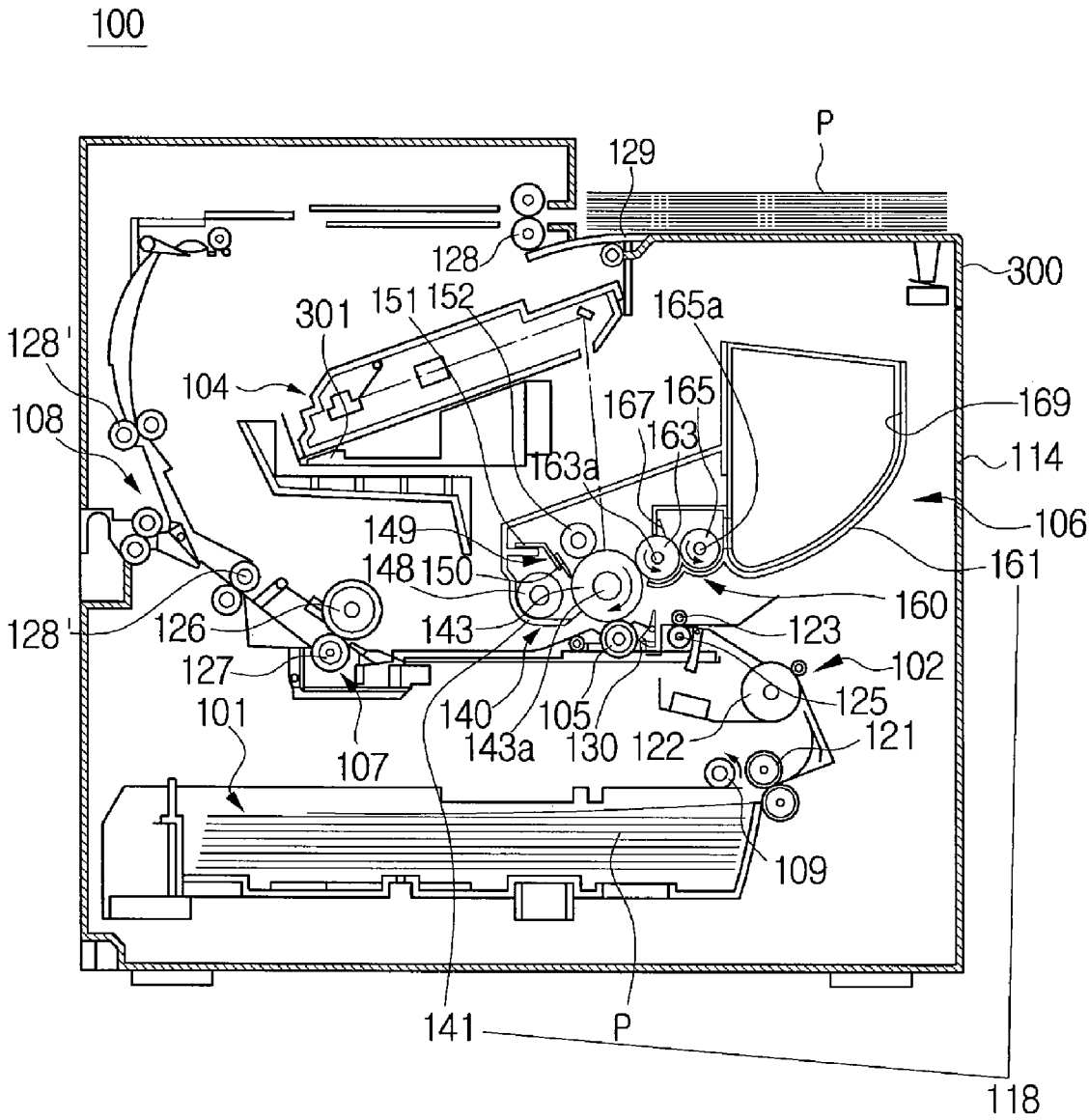
FIG. 4 is a schematic view illustrating a laser printer according to an embodiment of the present general inventive concept.

FIG. 4 is a schematic view illustrating an image forming device 100 according to an embodiment of the present general inventive concept. Although not illustrated in FIG. 4, the image forming device 100 includes a roller spacing unit 200 described below with reference to FIGS. 5 and 6.

The image forming device 100 may be a laser printer 100 that prints and outputs data input from an external device, such as a computer. However, it should be understood that the present general inventive concept is not limited to the laser printer 100, and other image forming devices can be used with the present general inventive concept.

The laser printer 100 includes a stack unit 101 to stack sheets of paper P, a transfer unit 102 to transfer the paper P from the stack unit 101, a process cartridge 106 to form a developer image on the paper P transferred by the transfer unit 102, a fusing unit 107 to fuse the developer image onto the paper P by using heat and pressure, and a discharge unit 108 to discharge the paper P having the developer image fused thereon.

The stack unit 101 includes a paper feeding cassette having a paper plate supported by a resilient spring to resiliently ascend and descend the paper P.

The transfer unit 102 includes a pickup roller 109 to feed the paper P from the stack unit 101 sheet by sheet, a first transfer roller 121 and a second transfer roller 122 to transfer the paper P fed by the pickup roller 109, and a register roller 123 and a backup roller 125 to engage each other to align a leading end of the paper P transferred by the first and the second transfer rollers 121 and 122. The transfer unit 102 may include one or more auxiliary rollers 128' disposed along a paper transfer path.

A paper sensor 130 is located behind the register roller 123 (i.e., downstream of the paper transfer path) to detect a location of the leading end of the paper P.

The process cartridge 106 includes a photoconductive medium unit 140, a developing unit 160, the roller spacing unit 200 (see FIGS. 5 and 6), and a housing 118 to integrate the photoconductive medium unit 140, the developing unit 160, and the roller spacing unit 200 into a single assembly unit detachably mountable in a body 114 (i.e., a frame of the body 114) of the laser printer 100.

Figure 5:
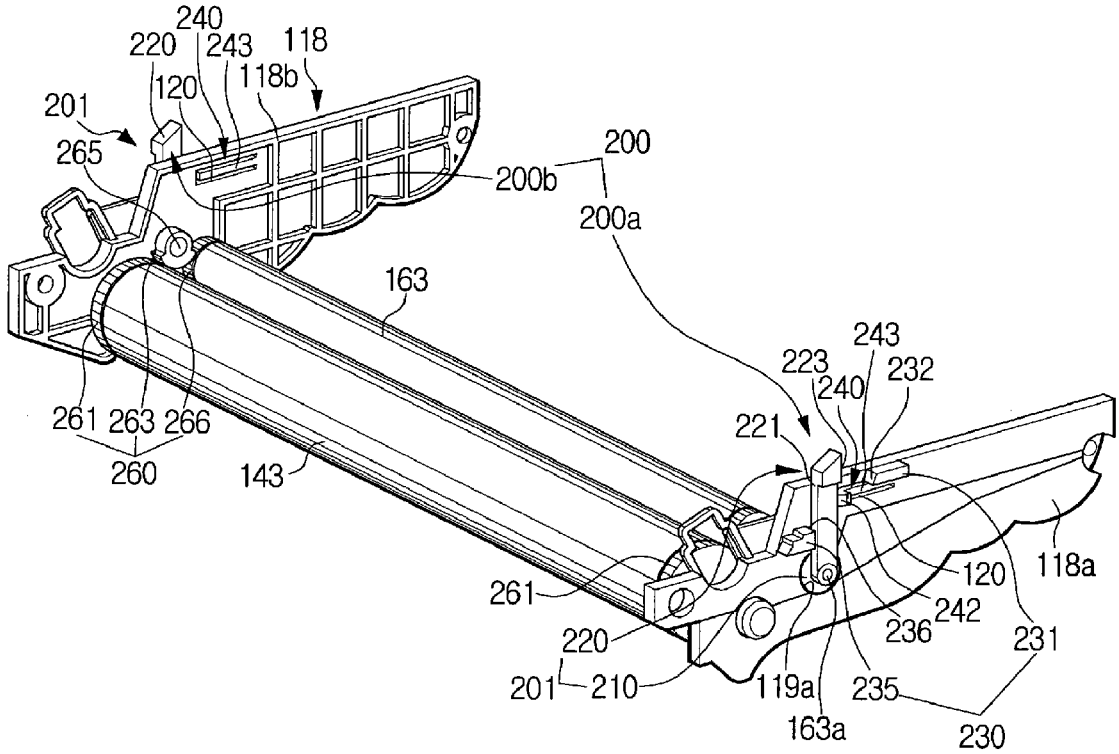
FIGS. 5 and 6 are partial perspective views illustrating a photoconductive medium, a developing roller, and a roller spacing unit of a process cartridge of the laser printer of FIG. 4, according to an embodiment of the present general inventive concept.
Figure 6:
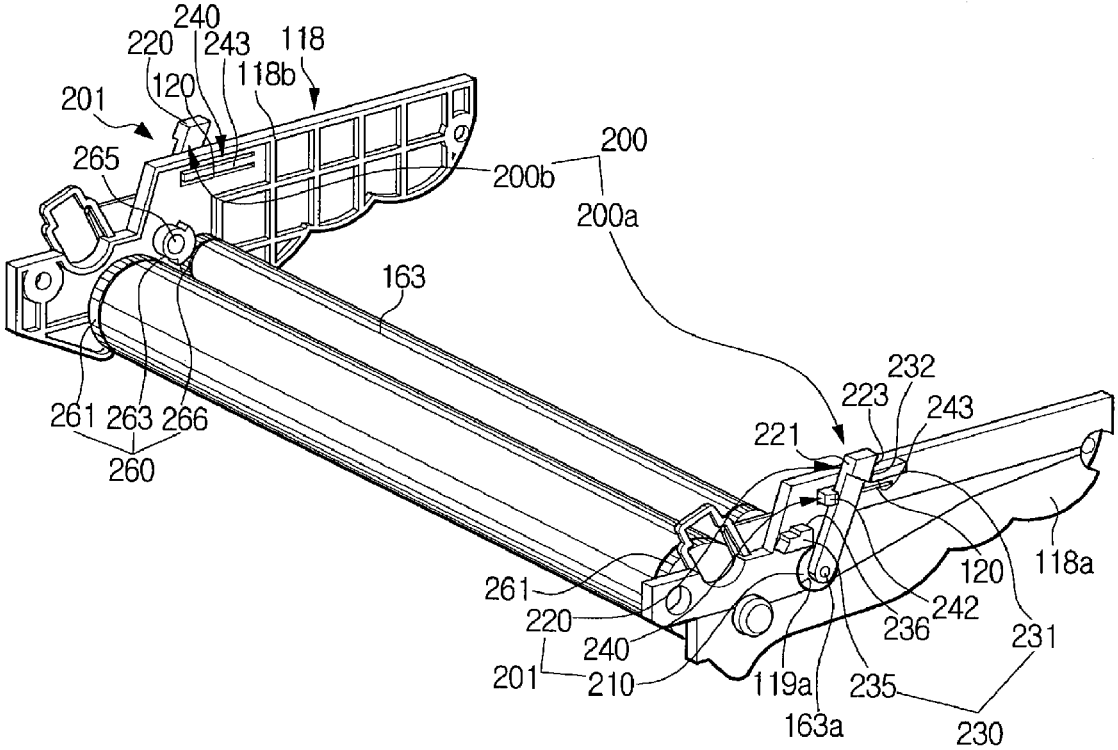

The photoconductive medium unit 140 includes a photoconductive medium 143 having opposite ends rotatably supported by the housing 118 (e.g., a right sidewall 118*a* and a left sidewall 118*b*, respectively, of the housing 118 see FIGS. 5 and 6). The right and left sidewalls 118*a* and 118*b* may be a frame on which the roller spacing unit 200 is disposed. The photoconductive medium 143 may be, for example, an organic photoconductive drum (OPC).

The photoconductive medium 143 includes a photoconductive medium gear (not illustrated) disposed at a left end portion of a photoconductive medium shaft 143*a* protruding from the left sidewall 118*b* of the housing 118. When the process cartridge 106 is mounted in a body frame of the body 114, the photoconductive medium gear engages with a driving gear (not illustrated) of a photoconductive medium gear train (not illustrated) that receives a driving force form a photoconductive medium driving motor (not illustrated) disposed in the body 114. The photoconductive medium 143 is rotated in one direction (e.g., in a clockwise direction) by the driving gear of the photoconductive medium gear train. Since a structure of the photoconductive medium gear train should be known to one of skill in the art, a detailed description and illustration thereof will not be provided.

A charge eliminator 148, a photoconductive medium cleaner 149, and a charger 152 are arranged at predetermined locations around an outer circumference of the photoconductive medium 143 in a rotational direction thereof.

The charge eliminator 148 may use a charge eliminating lamp to eliminate electric potentials charged on a surface of the photoconductive medium 143.

The photoconductive medium cleaner 149 removes developer that remains on the surface of the photoconductive medium 143 after the developer image is transferred from the photoconductive medium 143 to the paper P by a transfer roller 105 (i.e., developer waste). The photoconductive medium cleaner 149 includes a cleaning member 150, such as a cleaning blade. In some embodiments of the present general inventive concept, the developer image may be transferred to an intermediate transfer medium to be subsequently transferred to the paper P, as opposed to being directly-transferred to the paper P as described above. For example, the developer image may be transferred from the photoconductive medium 143 to a recording medium through an intermediate transfer roller, and/or to a storage medium.

The cleaning member 150 is located at a cleaning member fixing bracket 151 positioned in a photoconductive medium casing 141 such that the cleaning member 150 contacts the photoconductive medium 143 under a predetermined pressure.

The charger 152 includes a charging roller that is disposed in contact with the surface of the photoconductive medium 143, and forms a predetermined charging electric potential on the surface of the photoconductive medium 143 by applying a predetermined charging bias voltage from a charging bias power supply (not illustrated).

The developing unit 160 includes a developing roller 163 located in a developing casing 161 opposite the photoconductive medium 143 and being separated from the photoconductive medium 143 by a predetermined gap G (see FIG. 13), a supply roller 165 to supply the developer to the developing roller 163, a developer regulating blade 167 to regulate a thickness of a developer layer adhered to the developing roller 163, and a developer storage part 169 to store the developer.

The developing roller 163 develops an electrostatic latent image formed by a laser scanning unit (LSU) 104 on the surface of the photoconductive medium 143 by adhering the developer to the electrostatic latent image. The developing roller 163 is opposite to, and is spaced apart from, the photoconductive medium 143 by the predetermined gap G (see FIG. 13). A predetermined developing bias voltage is applied to the developing roller 163 at a level that is lower than a bias voltage applied to the supply roller 165 from a developing bias power supply (not illustrated).

Referring back to FIG. 4, the LSU 104 is fixed to an LSU fixing bracket 301 above the process cartridge 106. The LSU 104 scans laser beams emitted from a laser diode according to an image signal input from an external device (such as PC) to the surface of the photoconductive medium 143, which is charged with the predetermined electric potential by the charger 152, and thereby forms the electrostatic latent image having a low level of electric potential that is lower than the charging electric potential. The transfer roller 105 is disposed under the photoconductive medium 143 of the process cartridge 106.

The transfer roller 105 transfers the developer image formed on the photoconductive medium 143 to the paper P and is arranged to apply a predetermined pressure to the photoconductive medium 143. A predetermined transfer bias voltage is applied to the transfer roller 105 from a transfer bias power supply (not illustrated) to transfer the developer image formed on the photoconductive medium 143 to the paper P. As discussed above, the transfer roller 105 may transfer the developer image to an intermediate transfer medium, before or instead of transferring the developer image to the paper P.

The fusing roller 107 includes a heating roller 126 to heat the developer image transferred from the photoconductive medium 143 to the paper P by the transfer roller 105, and a compression roller 127 to apply a pressure to the developer image.

The discharging unit 108 includes a discharge roller 128 to discharge the printing-completed paper P and a stack 129 to stack and support the discharged paper P.

FIGS. 5 and 6 are partial perspective views illustrating the photoconductive medium 143, the developing roller 163, and the roller spacing unit 200 of the process cartridge 106 used with the laser printer 100 illustrated FIG. 4. Referring to FIGS. 4 to 6, the developing roller 163 includes a developing roller gear (not illustrated) formed at a left end portion of a developing roller shaft 163*a* protruding from the left sidewall 118*b* of the housing 118. The developing roller gear is engaged with the photoconductive medium gear through an idle gear and a deceleration gear (not illustrated). Accordingly, when the photoconductive medium 143 is rotated in the clockwise direction, the developing roller 163 is rotated in an opposite direction (i.e. in a counter clockwise direction) by the photoconductive medium gear, the idle gear, the deceleration gear, and the developing roller gear.

The supply roller 165 supplies the developer to the developing roller 163 by using a potential difference between the supply roller 165 and the developing roller 163, and is in contact with one side of the developing roller 163 to form a nip. The developer is conveyed to a lower space between the supply roller 165 and the developing roller 163 by the supply roller 165 in the developing casing 161.

The supply roller 165 includes a supply roller gear (not illustrated) formed on a left end portion of a supply roller shaft 165*a* protruding from the left sidewall 118*b* of the housing 118. The supply roller gear is engaged with the deceleration gear, which is engaged with the developing roller gear. Accordingly, when the photoconductive medium 143 is rotated in the counter clockwise direction, the supply roller 165 is rotated in the same direction (i.e., in the counter clockwise direction) by the photoconductive medium gear, the idle gear, the deceleration gear, and the supply roller gear.

A predetermined developer supply bias voltage is applied to the supply roller 165 at a level higher than the developing bias voltage applied to the developing roller 163 by the developer supply bias power supply (not illustrated). Accordingly, the developer conveyed to the lower space between the supply roller 165 and the developing roller 163 is supplied with an electric charge from the supply roller 165 and carries the electric charge, thereby being attracted to the developing roller 163 having a relatively low level of electric charge. Accordingly, the developer is conveyed to the nip between the supply roller 165 and the developing roller 163.

The developer regulating blade 167 regulates the developer supplied to the developing roller 163 by the supply roller 165 such that a film formed on the developing roller 163 has a predetermined thickness.

The developer storage part 169 contains and stores the developer and is detachably mountable in the developing casing 161. An agitator (not illustrated) is disposed in the developer storage part 169 to agitate the stored developer. Since agitators are known to those of skill in the art, a detailed description of the agitator is not provided here.

The roller spacing unit 200 spaces the developing roller 163 apart from the photoconductive medium 143 by a predetermined distance to maintain the developing roller 163 and the photoconductive medium 143 in a non-contact state when the laser printer 100 and/or the process cartridge 106 are not in use. The roller spacing unit 200 maintains the non-contact state until the laser printer 100 and/or the process cartridge 106 are delivered to a user. The roller spacing unit 200 includes a right spacing part 200*a* and a left spacing part 200*b*. The right spacing part 200*a* and the left spacing part 200*b* have similar structures, except that the right spacing part 200*a* is disposed at the right sidewall 118*a* of the housing 118 and right end portions of the photoconductive medium 143 and the developing roller 163, and the left spacing part 200*b* is disposed at the left sidewall 118*b* of the housing 118 and left end portions of the photoconductive medium 143 and the developing roller 163. For explanation purposes and to keep the description brief, only the right spacing part 200*a* will be explained hereinbelow. However, the description of the right spacing part 200*a* can also be applied to the left spacing part 200*b*.

Figure 7:
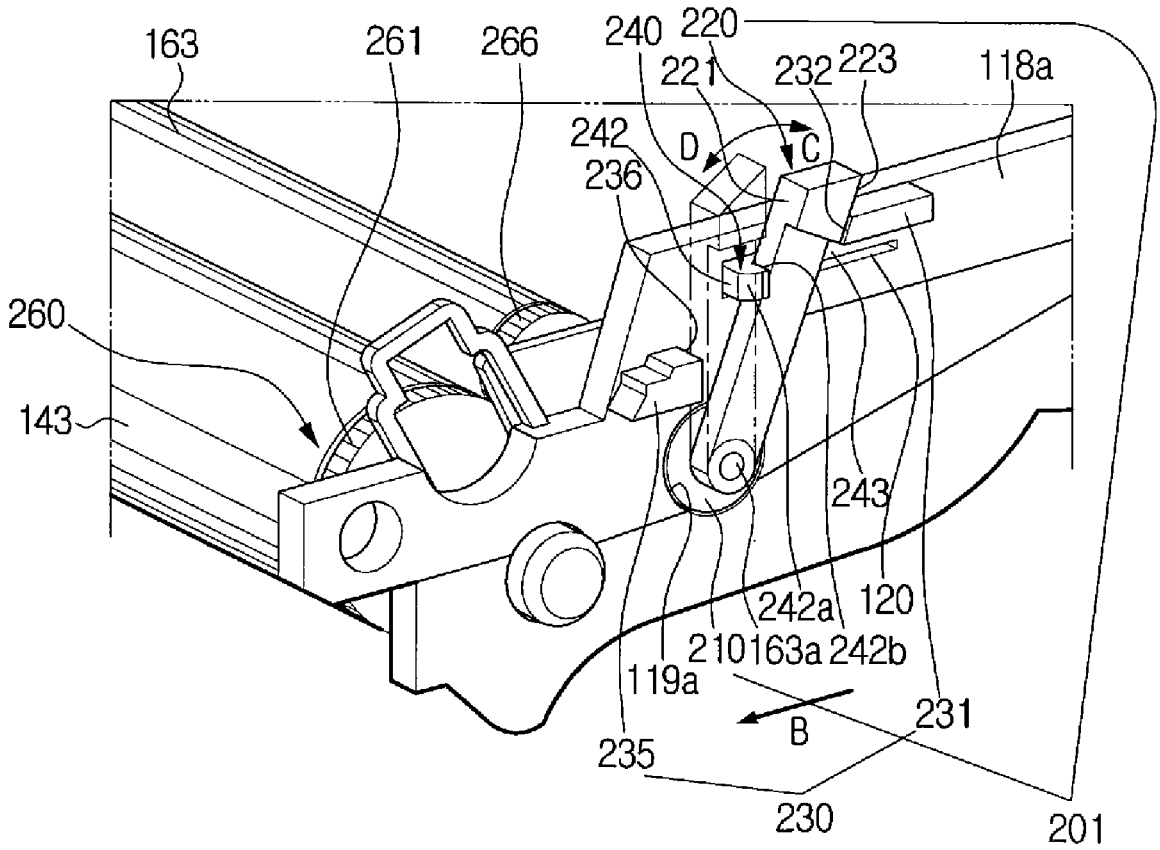
FIG. 7 is a perspective view illustrating a right spacing part of the roller spacing unit of FIG. 6, according to an embodiment of the present general inventive concept.
Figure 8A:
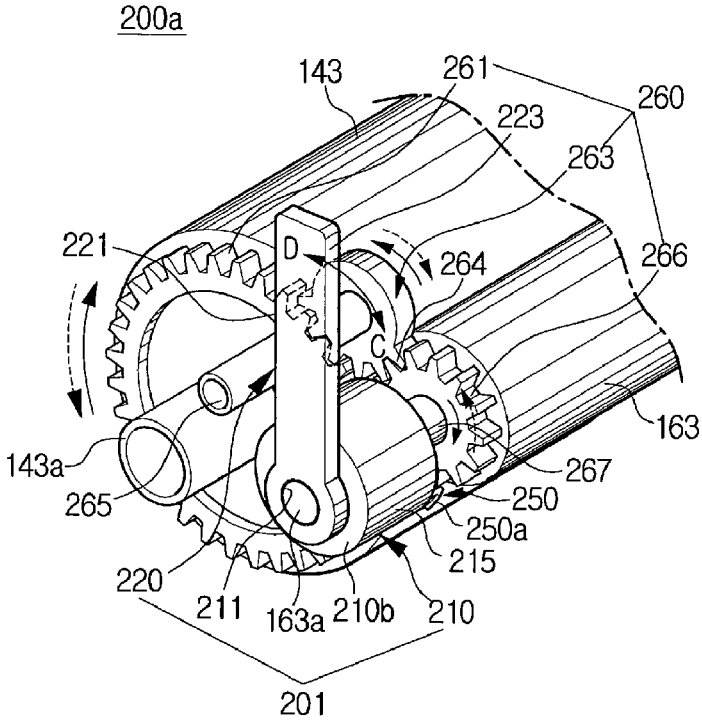
FIGS. 8A to 8B are a perspective view and a right side view, respectively, illustrating the right spacing part of the roller spacing unit of FIG. 6, when a lever is in a vertical position according to an embodiment of the present general inventive concept.
Figure 8B:
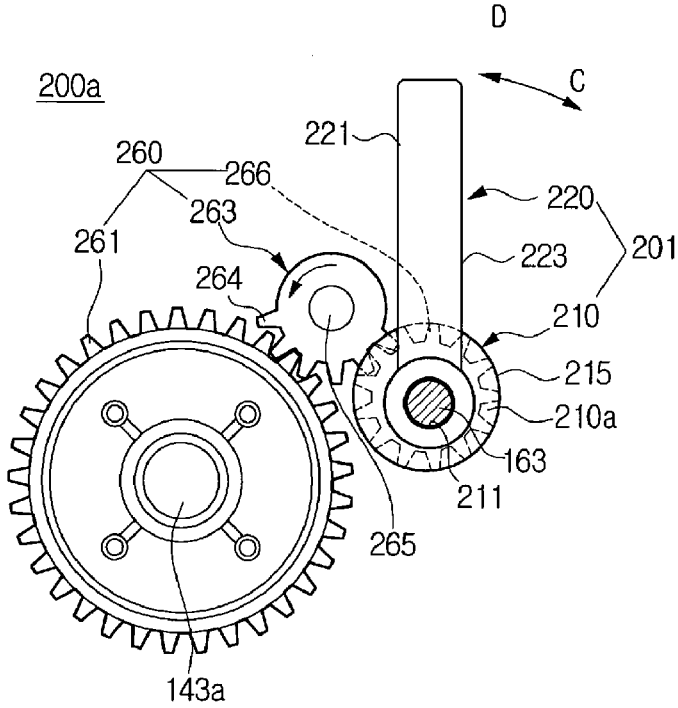
Figure 9A:
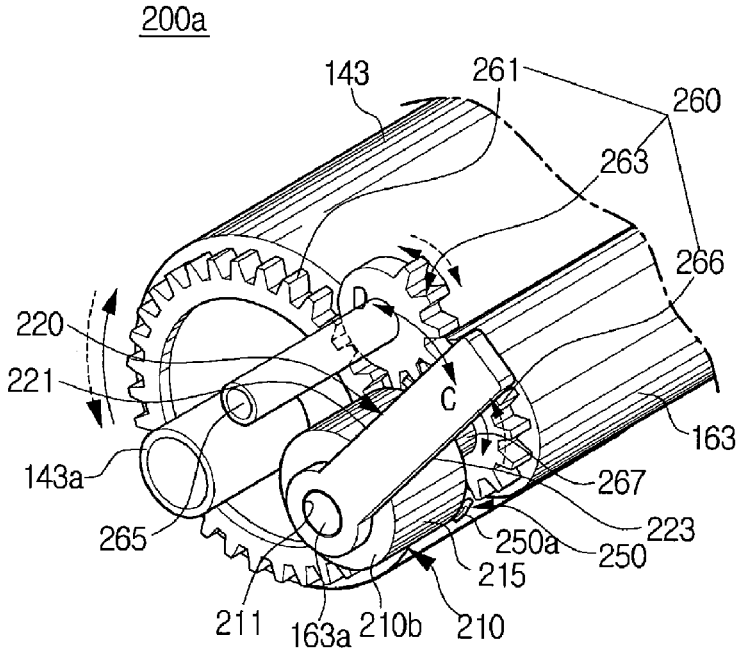
FIGS. 9A to 9B are a perspective view and a right side view, respectively, illustrating the right spacing part of the roller spacing unit of FIG. 6, when the lever is in an inclined position according to an embodiment of the present general inventive concept.
Figure 9B:
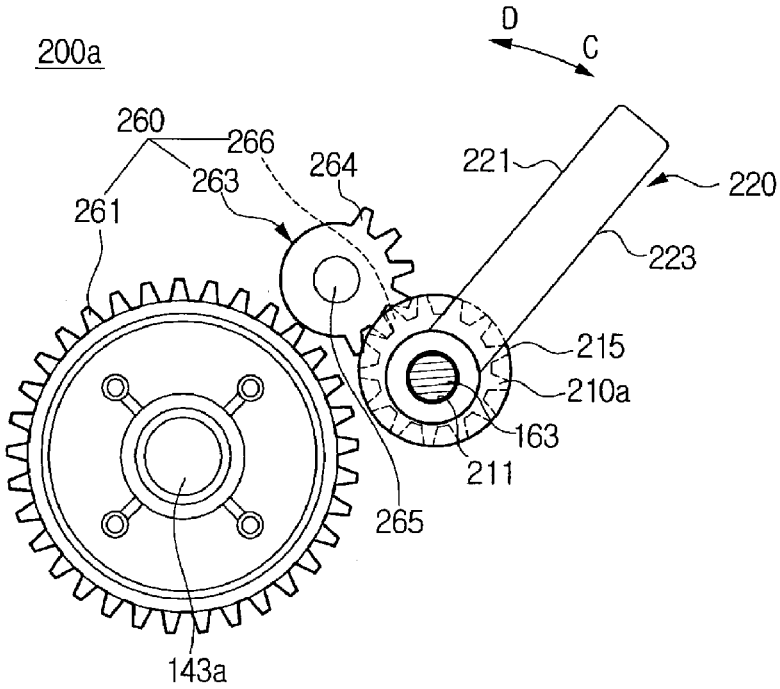
Figure 10A:
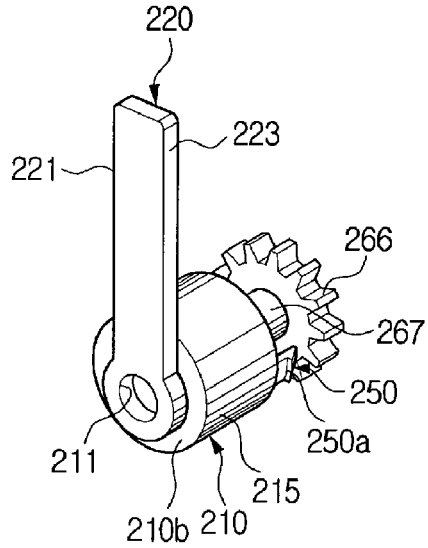
FIGS. 10A to 10C are a perspective view, a left side view, and a right side view, respectively, illustrating a rotary gear of a power transmitting member and a bushing member of the right spacing part of the roller spacing unit of FIG. 6, according to an embodiment of the present general inventive concept.
Figure 10B:
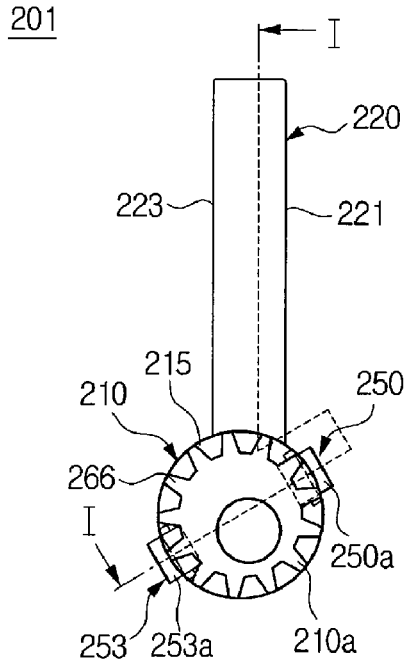
Figure 10C:
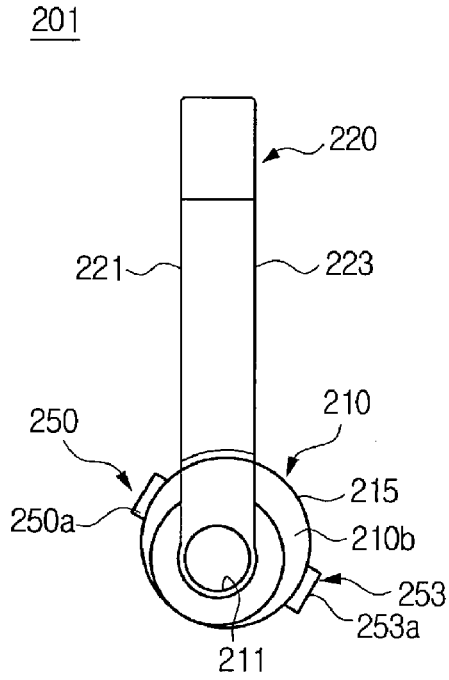
Figure 11:
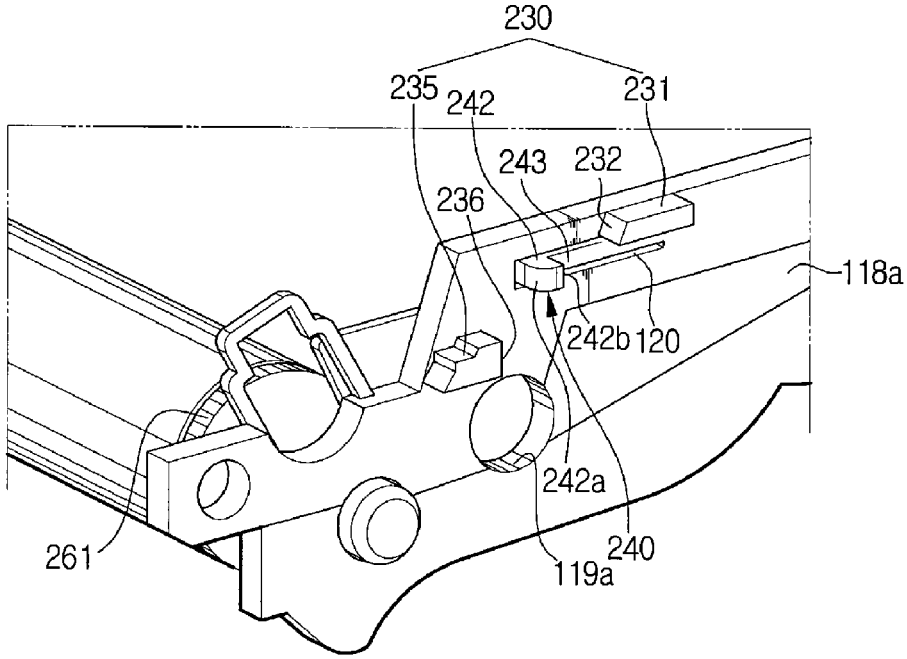
FIG. 11 is a partial perspective view illustrating the right spacing part of the roller spacing unit of FIG. 7, except the bushing member according to an embodiment of the present general inventive concept.
Figure 12:
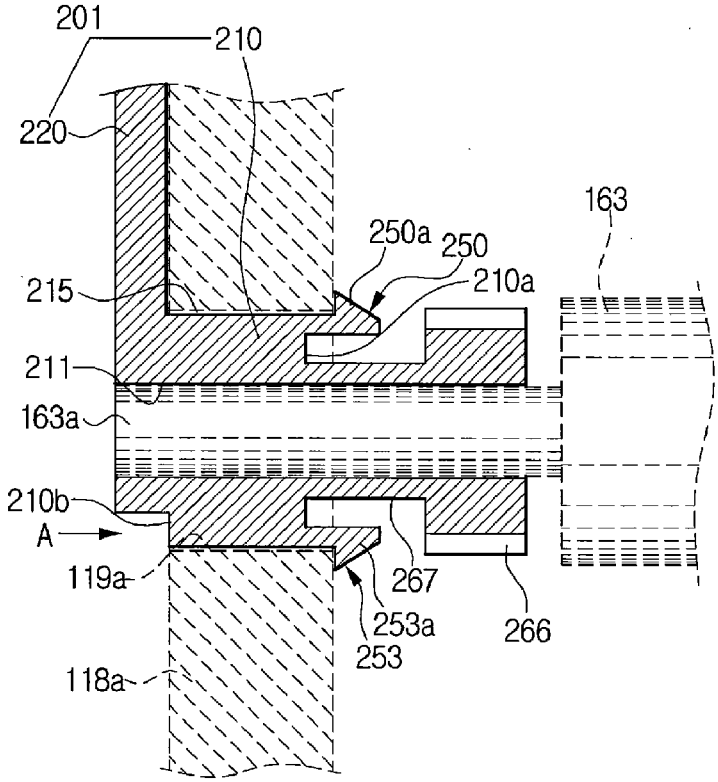
FIG. 12 is a partial cross section view taken along the line I-I of FIG. 10B, illustrating the bushing member of the right spacing part of the roller spacing unit of FIG. 6 in an assembled state according to an embodiment of the present general inventive concept.
Figure 13:
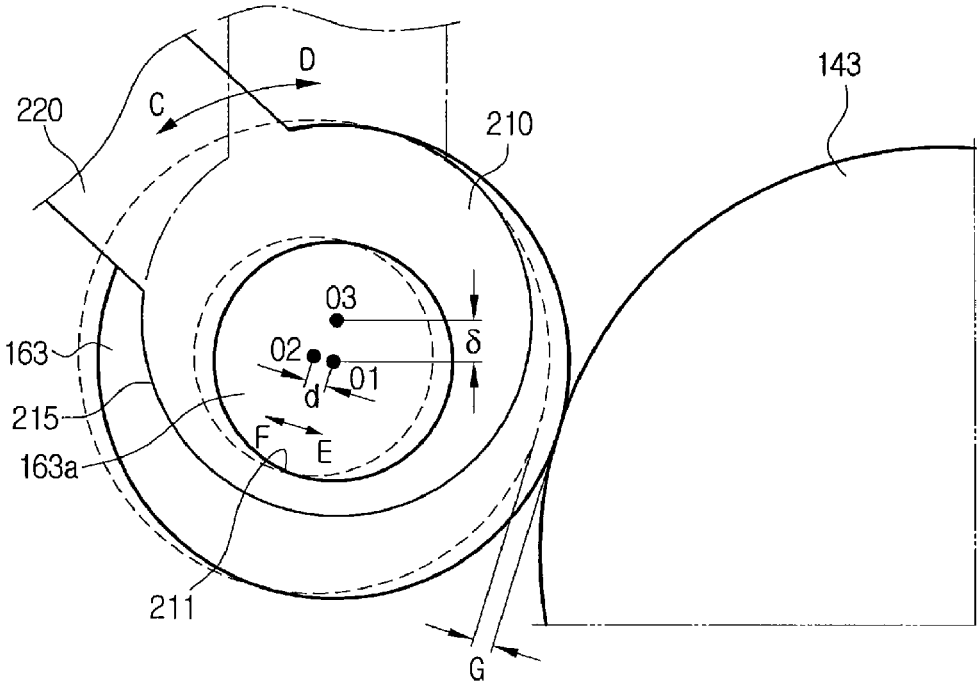
FIG. 13 is a view illustrating an operation of the bushing member of the right spacing part of the roller spacing unit of FIG. 7 according to an embodiment of the present general inventive concept.

FIG. 7 is a perspective view illustrating the right spacing part 200*a* of the roller spacing unit 200 of FIG. 6. FIGS. 8A to 8B are a perspective view and a right side view, respectively, illustrating the right spacing part 200*a* when a lever 200 is in a vertical position. FIGS. 9A to 9B are a perspective view and a right side view, respectively, illustrating the right spacing part 200*a* when the lever 200 is in an inclined position. FIGS. 10A to 10C are a perspective view, a left side view, and a right side view, respectively, illustrating a rotary gear 266 of a power transmitting member 260 and a bushing member 201 of the right spacing part 200*a*. FIG. 11 is a partial perspective view illustrating the right spacing part 200*a*, except the bushing member 201. FIG. 12 is a partial cross section view taken along the line I-I of FIG. 10B, illustrating the bushing member 201 of the right spacing part 200*a* in an assembled state. FIG. 13 is a view illustrating an operation of the bushing member 201 of the right spacing part 200*a*.

Referring to FIGS. 5 to 7, the right spacing part 200*a* spaces the right end portion of the developing roller 163 from the corresponding right end portion of the photoconductive medium 143, and includes the bushing member 201 having a busing 210, the power transmitting member 260, and a stopping member 230.

The bushing member 201 includes the bushing 210 rotatably supported in a fixing hole 119*a* formed on the right sidewall 118*a*. Also, as illustrated in FIG. 7, the right spacing part 200*a* further includes a position holding member 240 disposed between first and second stopping protrusions 231 and 235 of the stopping member 230 to hold the lever 220 in a position after the lever 220 moves the bushing 210 to a first or second position.

As illustrated in FIGS. 10A, 10B, 10C and 12, an inner diameter part 211 of the bushing 210 rotatably supports the right end portion of the developing roller shaft 163*a* of the developing roller 163 inserted into the inner diameter part 211, and an outer diameter part 215 of the bushing 210 is rotatably supported by the fixing hole 119*a* of the right sidewall 118*a*.

As illustrated in FIG. 13, the inner diameter part 211 that supports the right end portion of the developing roller shaft 163*a* and the outer diameter part 215 are non-concentric circles such that the inner and outer diameters do not have a common center. In other words, a first center point 01 of the inner diameter part 211 is distanced from a third center point 03 of the outer diameter part 215 by 6. Accordingly, when the bushing 210 is rotated from a first position drawn by a solid line (i.e., a normal position) to a second position (i.e., a separation position) drawn by a dashed line by the lever 220

(described below), the first center point 01 of the inner diameter part 211 is shifted (moved) to a second center point 02, and the right end portion of the developing roller shaft 163*a* is moved by as much as a predetermined distance "d," thereby moving the developing roller 163 from the normal position (solid line) to the separation position (dashed line). In the normal position, the developing roller 163 closely contacts the photoconductive medium 143 under a predetermined pressure. In the separation position, the developing roller 163 is spaced apart from the photoconductive medium 143 by the predetermined gap G.

Referring back to FIGS. 1A, 10B, 10C and 12, an inner end portion 210*a* of the bushing 210 has a first hook member 250 and a second hook member 253. Each of the first and second hook members 250 and 253 protrude from the inner end portion 210*a* by a predetermined distance and have a resilience. The first and the second hook members 250 and 253 include hook protrusions 250*a* and 253*a*, respectively, formed at ends thereof. The inner end portion 210*a* of the bushing 210 is moved towards the fixing hole 119*a* from an outside of the right sidewall 118*a* in a direction A (see FIG. 12) in order for the bushing 210 to be inserted through the fixing hole 119*a*. The hook protrusions 250*a* and 253*a* of the first and the second hook members 250 and 253 are inserted through the fixing hole 119*a* along with the bushing 210 and are locked onto an inner edge of the fixing hole 119*a* while the developing roller shaft 163*a* of the developing roller 163 is inserted into the bushing 210 through the inner diameter part 211.

The bushing member 201 has the lever 220 to rotate the bushing 210. The lever 220 vertically protrudes from an outer end portion 210*b* of the bushing 210.

The lever 220 may be operated by the user to rotate the bushing 210 to the first position (solid line of FIGS. 6, 7, and 13) and the second position (dashed line of FIGS. 5, 7, and 13). The lever 220 may also be operated by a rotation force transmitted to the bushing 210 through the power transmitting member 260 after the process cartridge 106 is mounted in the frame of the body 114 of the laser printer 100 (see FIG. 4) to rotate the bushing 210 from the second position (i.e., the separation position) to the first position (i.e., the normal position).

In addition, the lever 220 prevents the bushing 210 from further moving in the direction A by contacting the right sidewall 118*a* after the hook protrusions 250*a* and 253*a* are locked onto the inner edge of the fixing hole 119*a* when the bushing 210 is inserted through the fixing hole 119*a*. Accordingly, the bushing 210 does not escape from the fixing hole 119 and instead remains fixed due to the presence of the lever 220 and the first and the second hook members 250 and 253.

As illustrated in FIGS. 5-7 and 11, the stopping member 230 restricts a rotation range of the lever 220.

The stopping member 230 includes the first stopping protrusion 231 and the second stopping protrusion 235, which are disposed on an outer surface of the right sidewall 118*a* and spaced apart from each other by a predetermined distance. The first stopping protrusion 231 has a first inclination surface 232 formed at one end thereof to restrict movement of the lever 220 in a first direction. That is, the first inclination surface 232 prevents the lever 220 from moving beyond an inclination position where the bushing 210 is maintained in the first position (i.e., the normal position-see FIG. 6). The second stopping protrusion 235 has a first vertical surface 236 to restrict movement of the lever 220 in a second direction opposite to the first direction. That is, the first inclination surface 236 prevents the lever 220 from moving beyond a vertical position where the bushing 210 is maintained in the second position (i.e., the separation position-see FIG. 5). Accordingly, when the lever 220 is operated by the user or by the rotation force transmitted to the bushing 210 through the power transmitting member 260 to rotate the bushing 210 from the first position to the second position or from the second position to the first position, the lever 220 does not move the bushing 210 beyond the first or second position and accurately stops movement, after moving the bushing 210 to the first or second position.

As illustrated in FIGS. 8A to 9B, the power transmitting member 260 includes a power transmitting gear 261, the rotary gear 266, and an idle gear 263.

The power transmitting gear 261 is fixed at a right end portion of the photoconductive medium shaft 143*a* between the right sidewall 118*a* and the photoconductive medium 143. The power transmitting gear 261 is rotated by a driving force transmitted to the photoconductive medium gear (not illustrated) from the photoconductive medium driving motor (not illustrated) through the photoconductive medium gear train (not illustrated).

The rotary gear 266 is integrally connected with the bushing 210 by a connecting shaft 267 to rotate in combination with the bushing 210. Accordingly, when one of the rotary gear 266 and the bushing 210 rotates, the other one of the rotary gear 266 and the bushing 210 is also rotated along therewith.

The idle gear 263 is rotatably fixed at the right sidewall 118*a* by a fixing shaft 265 to selectively transmit a rotation force of a first one of the power transmitting gear 261 and the rotary gear 266 to a second one of the power transmitting gear 261 and the rotary gear 266, when the first one rotates.

The idle gear 263 includes a partial tooth part 264. The partial tooth part 264 is formed such that the rotation force of the first one of the power transmitting gear 261 and the rotary gear 266 is transmitted within the rotation range of the lever 220 restricted by the first stopping protrusion 231 and the second stopping protrusion 235 of the stopping member 230 (i.e., a range of rotating the bushing 210 between the first position and the second position) to the second one of the power transmitting gear 261 and the rotary gear 266.

Accordingly, when the bushing 210 is positioned at the second position, as illustrated in FIGS. 8A and 8B, by the lever 220 and the photoconductive medium 143 rotates in the same rotation direction as that in a rotational direction of an image forming process (i.e., a clockwise direction indicated by a solid line of FIGS. 8A and 8*b*), the idle gear 263 that meshes with the power transmitting gear 261 via the partial tooth part 264 is rotated in the counter clockwise direction about the fixing shaft 265, and the rotary gear 266 that meshes with the idle gear 263 via the partial tooth part 264 is rotated in the clockwise direction about the developing roller shaft 163*a*. As a result, as illustrated by a solid line of FIG. 13, the bushing 210 is rotated in a direction to allow the developing roller 163 to contact the photoconductive medium 143 (i.e., the clockwise direction), and the lever 220 extending from the bushing 210 is rotated in a direction of arrow C.

Accordingly, as illustrated in FIGS. 9A and 9B, when the power transmitting gear 261 further rotates thereby separating the partial tooth part 264 of the idle gear 263 from the power transmitting gear 261, the power transmitting gear 261 is idly rotated and the idle gear 263 and the rotary gear 266 stop rotating. As a result, the bushing 210 is positioned in the first position (i.e., the normal position). At this time, the first inclination surface 236 prevents the second operation surface 223 of the lever 220 from moving.

On the other hand, when the bushing 210 is positioned at the first position illustrated in FIGS. 9A and 9B and the rotary gear 266 is rotated by the lever 220 in a direction of arrow D while a position holding protrusion 242 of the position holding member 240 is pushed to a down position (described below), the idle gear 263 that meshes with the rotary gear 266 via the partial tooth part 264 is rotated in the clockwise direction (dashed line of FIGS. 9A and 9B).

When the rotary gear 266 further rotates thereby meshing the partial tooth part 264 of the idle gear 263 with the power transmitting gear 261, the partial tooth part 264 rotates the power transmitting gear 261 in the counter clockwise direction.

Accordingly, when the first operation surface 221 of the lever 220 is stopped in the vertical position by the first vertical surface 236 of the second stopping protrusion 235 as illustrated in FIGS. 8A and 8B, the bushing 210 is positioned in the second position (i.e., the separation position) where the busing 210 causes the developing roller 163 to space apart from the photoconductive medium 143 by the predetermined gap G.

As illustrated in FIGS. 5 to 7, the position holding member 240 has the position holding protrusion 242 having a support portion 243 integrally formed with the right sidewall 118*a* and defined by a cutting portion 120 so as to elastically move between an up position and the down position. In the up position, the position holding protrusion 242 pops out toward a moving path of the lever 220. In the down position, the position holding protrusion 242 departs away from the moving path of the lever 220. In other words, the position holding protrusion 242 is elastically movable with respect to the right sidewall 118*a* in and out of the housing 118. As illustrated in FIGS. 7 and 11, the position holding protrusion 242 includes a second inclination surface 242*a* facing the first vertical surface 236 of the second stopping protrusion 235, and a second vertical surface 242*b* facing the first inclination surface 232 of the first stopping protrusion 231.

When the lever 220 is in the vertical position and the inclination position as illustrated by the chain and solid lines of FIG. 7, respectively, the position holding protrusion 242 brings the second inclination surface 242*a* and the second vertical surface 242*b* into contact with a second operation surface 223 and a first operation surface 221 of the lever 220, respectively, and thus maintains the lever 220 in the vertical position and the inclination position using a resilient force of the lever 220. When the lever 220 is pushed by the rotation force transmitted to the bushing 210 through the power transmitting member 260 in the direction of arrow C after the process cartridge 106 is mounted in the body 114 of the laser printer 100 (see FIG. 4) in the direction of arrow B, the position holding protrusion 242 is moved to the down position by the second operation surface 223 of the lever 220 and moves the lever 220 to the inclination position.

Operations of assembling the roller spacing unit 200 (described above) with the process cartridge 106 and mounting the assembled process cartridge 106 to the body 114 will now be described with reference to FIGS. 4 to 13.

The process cartridge 106 incorporating elements except for the roller spacing unit 200 and the bushing members 201 of the right and the left spacing parts 200*a* and 200*b*, are prepared. The process cartridge 106 has the power transmitting gears 261 and the idle gears 263 of the right and the left spacing parts 200*a* and 200*b* assembled therein.

In order to install the bushing member 201 of the right spacing part 200*a* in the fixing hole 119*a* of the right sidewall 118*a*, the right end portion of the developing roller shaft 163*a* is inserted into the rotary gear 266 and the inner diameter part 211 of the bushing 220 of the right spacing part 200*a*. At the same time, the inner end portion 210*a* of the bushing 210 is inserted through the fixing hole 119*a* in the direction of arrow A (see FIG. 12). At this time, the first and the second hook members 250 and 253 are inserted through the fixing hole 119*a* along with the inner end portion 210*a* of the bushing 210.

Accordingly, as illustrated in FIG. 12, when the hook protrusions 250*a* and 253*a* of the first and the second hook members 250 and 253, respectively, are locked onto the inner edge of the fixing hole 119*a*, the lever 220 contacts an outer surface of the right sidewall 118*a*, thereby preventing the bushing 210 from being inserted further in the direction of arrow A. Due to the presence of the lever 220 and the first and the second hook members 250 and 253, the bushing 210 does not escape from the fixing hole 119*a* and is rotatably fixed.

If the lever 220 is in the vertical position as illustrated by the dashed line in FIGS. 7 and 13 (i.e., if the bushing 210 is in the second position), the developing roller 163 and the photoconductive medium 143 are spaced apart from each other by the predetermined gap G (i.e., the separation position). Also, as illustrated in FIGS. 8A and 8B, if the lever 220 is in the vertical position, the partial tooth part 264 of the idle gear 263 is meshed with the power transmitting gear 261 and the rotary gear 266.

In the same manner as the right spacing part 200*a*, the bushing member 201 of the left spacing part 200*b* is installed in the fixing hole 119*b* of the left sidewall 118*b*.

The process cartridge 106 assembled with the bushing members 201 of the right and the left spacing parts 200*a* and 200*b* of the roller spacing unit 200 is placed in the body 114 through a door 300 of the laser printer 100 (see FIG. 4) to perform a test printing operation for an image quality test.

Next, as illustrated in FIG. 7, the process cartridge 106 moves along a mounting guide (not illustrated) formed in the body 114 in the direction of arrow B.

Accordingly, in order to contact the developing roller 163 to the photosensitive medium 143 to perform the test printing, the photosensitive medium 143 is rotated by the driving force of the photosensitive medium driving motor (not illustrated) connected to the photosensitive medium gear (not illustrated) through the photosensitive medium gear train (not illustrated) in the same rotation direction as the image forming process (i.e., the clockwise direction) by a predetermined angle, for example, more than 180°.

As a result, as described above with reference to FIGS. 8A through 9B, the bushing 210 is rotated by the power transmitting gear 261, the idle gear 263, and the rotary gear 266 from the second position (the separation position) to the first position (the normal position).

Accordingly, the lever 220 is rotated to the second center point 02 of the inner diameter 211 of the bushing 210 (which is in the second position illustrated by a dashed line in FIG. 13), thereby bringing the second operation surface 223 into contact with the second inclination surface 242*a* of the position holding protrusion 242 and pushing the second inclination surface 242*a* in the direction of the arrow C. The position holding protrusion 242 pushed by the lever 220 is moved from the up position to the down position. Accordingly, the lever 220 is rotated to the inclination position after passing the position holding protrusion 242. The center point of the inner diameter 211 of the bushing 210 moves from the second center point 02 to the first center point 01 by as much as the predetermined distance "d" towards the photoconductive medium 143 (as illustrated by the solid line in FIG. 13), and the right and the left end portions of the developing roller shaft 163*a* supported by the inner diameter part 211 move towards the photoconductive medium 143 by as much as the distance "d." As a result, the photoconductive medium 143 and the developing roller 163 are moved to the normal position (solid line of FIGS. 6, 7 and 13) in close contact with each other under a predetermined pressure.

In this state, the test printing is performed and then the process cartridge 106 can be detached and dismounted from the body 114 to be packaged separately from the body 114.

If the process cartridge 106 dismounted from the body 114 is not in use (e.g., before the process cartridge 106 is delivered to the user), an elastic layer and the surface of the photoconductive medium 143 and/or the developing roller 163 may be physically and chemically deformed or damaged. In order to prevent the deformation, the roller spacing unit 200 spaces out the developing roller 163 from the photoconductive medium 143.

More particularly, when the position holding protrusion 242 formed at the right and left sidewalls 118*a* and 118*b* is moved from the up position to the down position by the user, the lever 220 of each of the right and the left spacing parts 200*a* and 200*b* is rotated by the user in a direction of an arrow D until the first operation surface 221 is brought into contact with the first vertical inclination surface 236 of the second stopping protrusion 235.

At this time, as described above with reference to FIGS. 8A through 9B, the idle gear 263 meshed with the rotary gear 266 via the partial tooth part 264 is rotated in the clockwise direction to rotate the power transmitting gear 261 through the partial tooth part 264 in the counter clockwise direction.

Accordingly, when the first operation surface 221 of the lever 220 is stopped at the vertical position by the first vertical surface 236 of the second stopping protrusion 235, as illustrated by the dashed line in FIGS. 7, 8A and 8B, the partial tooth part 264 of the idle gear 263 is positioned to mesh with both the power transmitting gear 261 and the rotary gear 266.

In addition, the center point of the inner diameter part 211 of the bushing 220 moves from the first center point 01 to the second center point 02 by as much as the predetermined distance "d" away from the photoconductive medium 143, and thus the right and left end portions of the developing roller shaft 163*a* supported by the inner diameter part 211 are spaced apart from the photoconductive medium 143 by as much as the distance "d." As a result, the photoconductive medium 143 and the developing roller 163 are spaced apart from each other by the predetermined gap G (dashed line of FIGS. 5, 7 and 13).

The process cartridge 106, which is dismounted from the body 114 and has the developing roller 163 and the photoconductive medium 143 spaced apart from each other, can be packaged separately from the body 114.

The process cartridge 106 is then delivered to the user and is mounted to the body 114 according to the above-described mounting process.

According to the present embodiment described above, the roller spacing unit 200 of the laser printer 100 includes the right and the left spacing parts 200*a* and 200*b* to evenly space apart the photoconductive medium 143 and the developing roller 163 (which are in close contact with each other during a rotation operation) from each other when the photoconductive medium 143 and the developing roller 163 are not in use. Accordingly, physical and permanent compression-set of the elastic layer on the rollers 143 and 163 that would result from maintaining the two rollers 143 and 163 in a contact state or a partial contact state when the two rollers 143 and 163 are not in use, can be prevented by evenly spacing the rollers 143 and 163 apart. Additionally, image degradation that is caused when a high viscosity low molecular organic matter comes out from a surface of the elastic layer and is adhered to the surface in combination with the developer can also be prevented. A reliability of a product having the process cartridge 106 can be improved.

Also, according to the present embodiment, the roller spacing unit 200 includes the stopping member 230 and the position holding member 240 to guide and restrict the movement of the lever 220 such that the bushing 210 is in the first position when the photoconductive medium 143 and the developing roller 163 are in contact with each other, and the bushing 210 is in the second position when the photoconductive medium 143 and the developing roller 163 are spaced apart from each other by the predetermined gap G. Accordingly, it is possible to set the lever 220 to an accurate position, thus guaranteeing stable operation thereof. Also, it is possible to prevent the lever 220 from changing position during delivery of the process cartridge 106.

According to the present embodiment, the roller spacing unit 200 of the process cartridge 106 of the laser printer 100 is employed to space apart the photoconductive medium 143 and the developing roller 163 from each other by the predetermined gap G, and/or to bring the photoconductive medium 143 and the developing roller 163 into contact with each other. However, this description is not intended to limit the scope of the present general inventive concept. The roller spacing unit 200 of present embodiment may be applied to any two rollers that are rotated in close contact with each other under a predetermined pressure in the laser printer 100, or in other image forming devices. For example, the roller spacing unit 200 may space apart the photoconductive medium 143 and a charging roller (not illustrated) of the charger 152 from each other, and/or may bring the photoconductive medium 143 and the charging roller into contact with each other. Similarly, the roller spacing unit 200 may space apart the photoconductive medium 143 and the transfer roller 105 from each other, and/or may bring the photoconductive medium 143 and the transfer roller 105 into contact with each other.

Although the roller spacing unit 200 operates with the power transmitting gears 261 of the power transmitting members 260 of the right and the left spacing parts 200*a* and 200*b* separately from the photoconductive medium gear (not illustrated) connected with the photoconductive medium gear train (not illustrated), it should be understood that the spacing unit 200 may alternatively operate with the photoconductive medium gear train such that one of the power transmitting gears 261 of the power transmitting members 260 of the right and the left spacing parts 200*a* and 200*b* functions as the photoconductive medium gear, thereby making the photoconductive medium gear unnecessary.

Also, although the roller spacing unit 200 is employed in the laser printer 100, it can be employed in another type of image forming device having a process cartridge, such as a photocopier and a facsimile machine, and other devices with similar structures and/or operational principles.

An operation of the laser printer 100 having the process cartridge 106 mounted therein and having the roller spacing unit 200 according to an embodiment of the present general inventive concept will now be described below with reference to FIG. 4. It should be understood that the following description is exemplary and is not intended to limit the scope of the present general inventive concept.

When a document print command is input from, for example, an external PC to print a document, a controller (not illustrated) of the printer 100 drives the pickup roller 109 to pick up the paper P stacked on an uppermost portion of the stack unit 101. The paper P is conveyed to the register roller 123 by the first and the second transfer rollers 121 and 122.

The leading end of the paper P conveyed to the register roller 123 is aligned by the nip formed between the register roller 123 and the backup roller 125.

The paper P then passes through the nip between the register roller 123 and the backup roller 125 and continues to move. The leading end of the paper P operates the paper sensor 130 disposed between the register roller 123 and the transfer roller 105, and the paper sensor 130 transmits a paper detection signal to the controller.

The controller counts time until the paper P moves from the paper sensor 130 to the transfer roller 105 according to the paper detection signal. After the paper P is conveyed for a predetermined time corresponding to a time required to convey the paper P to a print process beginning point, the process cartridge 106 and the transfer roller 105 are operated.

While the paper P is conveyed to the print process beginning point, the electrostatic latent image is formed on the photoconductive medium 143 of the process cartridge 106 by the laser beams emitted from the LSU 104 according to the image signal, and the electrostatic latent image formed on the photoconductive medium 143 is developed into the developer image by the developing roller 163.

When the paper P reaches the photoconductive medium 143 of the process cartridge 106, the developer image formed on the photoconductive medium 143 is transferred to a surface of the paper P by the transfer roller 105 under the control of the controller. As discussed above, the transfer roller 105 may transfer the developer image to an intermediate transfer member, before or instead of transferring the developer image directly to the paper P.

The developer image transferred to the surface of the paper P is fused onto the paper by heat from the heating roller 126 and pressure from the compression roller 127 while passing through the fusing unit 107. The paper onto which the developer image is fused is then discharged towards the stack 129 by the discharge roller 128 of the discharging unit 108.

The above-described operations of picking up, developing, fusing, and discharging are performed with respect to a next paper P repeatedly until all of the contents of the document are printed.

According to embodiments of the present general inventive concept as described above, a roller spacing unit and a laser printer having the same include right and the left spacing parts to evenly space apart two rollers (e.g., a photoconductive medium and a developing roller or a charging roller that are in close contact with each other during a rotation operation) from each other when the two rollers are not in use. Accordingly, it is possible to (1) prevent an elastic layer from being physically and permanently compression-set as a result of maintaining the two rollers in a contact state or a partial contact state when the two rollers are not in use, (2) prevent image degradation caused when a high viscosity, low molecular organic matter comes out of the elastic layer and is adhered to a surface in combination with a developer, and (3) improve a reliability of a product, such as an image forming apparatus and a process cartridge having the roller spacing unit.

Also, according to embodiments of the present general inventive concept, a roller spacing unit and an image forming device include a stopping member and a position holding member to guide and restrict movement of a lever such that a bushing is in a first position when a photoconductive medium and a developing roller or a charging roller are in contact with each other, and in a second position when the developing roller and the photoconductive medium are spaced apart from each other by a predetermined gap. Accordingly, it is possible to set the lever to an accurate position and to guarantee stable operation of the lever. Also, it is possible to prevent the lever from changing position during delivery of a process cartridge having the lever disposed therein.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A roller spacing apparatus of an image forming device, the apparatus comprising:

a frame;

a first rotatable roller member having a first shaft;

a second rotatable roller member having a second shaft and being rotatable in close contact with the first roller member under a predetermined pressure; and at least one spacing part to space the first and the second roller members apart from each other by a predetermined gap such that the first and the second roller members are not in contact with each other when the first and the second roller members are not in use, the at least one spacing part including a bushing member having a bushing to rotatably support a first one of the first and second shafts on the frame and a lever positioned at the bushing to rotate the bushing, and the bushing has an outer diameter part and an inner diameter part to support the one of the first and second shafts, the inner and outer diameter parts being non-concentric circles such that a center point of the inner diameter part is at a different location from a center point of the outer diameter part, a stopping member disposed on the frame to restrict an operation range of the bushing, and a power transmitting member to selectively transmit an external rotation force to the bushing such that the bushing rotates in a direction;

wherein the power transmitting member comprises:

a power transmitting gear formed at a second one of the first and second shafts to be rotated by an external driving force, a rotary gear formed integrally with the bushing at the first one of the first and second shafts to be rotatable in combination with the bushing, and an idle gear having a partial tooth part that selectively transmits a rotation force of a first one of the rower transmitting gear and the rotary gear to a second one of the power transmitting gear and the rotary gear when the first one of the power transmitting gear and the rotary gear rotates.

2. The roller spacing apparatus as claimed in claim 1, wherein the at least one spacing part further comprises:

a first spacing part to space apart first ends of the first and second shafts from each other by the predetermined gap; and a second spacing part to space apart second ends of the first and second shafts from each other by the predetermined gap.

3. The roller spacing apparatus as claimed in claim 1, wherein the partial tooth part is formed such that the rotation force of the first one of the power transmitting gear and the rotary gear is transmitted within the operation range of the bushing restricted by the stopping member to the second one of the power transmitting gear and the rotary gear.

4. The roller spacing apparatus as claimed in claim 1, wherein:

the first roller member comprises a photoconductive medium to have an electrostatic latent image formed thereon; and the second roller member comprises a transfer roller to transfer a developer image from the photoconductive medium to a print medium or to an intermediate transfer medium.

5. The roller spacing apparatus as claimed in claim 1, wherein the stopping member comprises:

a first stopping protrusion disposed on the frame to restrict a first directional movement of the lever; and a second stopping protrusion disposed on the frame to restrict a second directional movement of the lever opposite to the first directional movement.

6. The roller spacing apparatus as claimed in claim 5, wherein the at least one spacing part further comprises:

a position holding member to hold the lever such that the bushing is in a first position to bring the first and the second roller members into contact with each other or a second position to space the first and the second roller members apart from each other by the predetermined gap.

7. The roller spacing apparatus as claimed in claim 6, wherein the position holding member comprises a position holding protrusion disposed on the frame between the first and the second stopping protrusions of the stopping member, the position holding protrusion being elastically movable between an up position, in which the position holding protrusion is located within a moving path of the lever, and a down position, in which the position holding protrusion is located outside of the moving path of the lever.

8. The roller spacing apparatus as claimed in claim 7, wherein the position holding protrusion is elastically movable by an external force applied thereto, or by the lever.

9. The roller spacing apparatus as claimed in claim 1, wherein:

the first roller member comprises a photoconductive medium to have an electrostatic latent image formed thereon; and the second roller member comprises a developing roller to develop the electrostatic latent image on the photoconductive medium.

10. The roller spacing apparatus as claimed in claim 1, wherein:

the first roller member comprises a photoconductive medium to have an electrostatic latent image formed thereon; and the second roller member comprises a charging roller to charge the photoconductive medium with a predetermined electric potential.

11. An image forming device, comprising:

a body having a body frame and at least one driving motor located on the body frame; and a process cartridge, including a first rotatable roller member having a first shaft, a second rotatable roller member that is rotatable in close contact with the first roller member under a predetermined pressure and having a second shaft, at least one spacing part to space the first and the second roller members apart from each other by a predetermined gap such that the first and the second roller members are not in contact with each other when the first and the second roller members are not in use, and a housing being detachably mounted on the frame to integrate the first and the second roller members with the at least one spacing part, wherein the at least one spacing part comprises a bushing member including at least one bushing and at least one lever positioned at the at least one bushing to rotate the at least one bushing, the at least one bushing being rotatably disposed in the housing to rotatably support a first one of the first and second shafts and having an inner diameter part to support the first one of the first and second shafts and an outer diameter part, and the inner and outer diameter parts being non-concentric circles such that a center point of the inner diameter part is at a different location from a center point of the outer diameter part, a stopping member disposed on the housing to restrict an operation range of the at least one bushing, and a power transmitting member connected to the driving motor to selectively transmit a rotation force from the driving motor to the at least one bushing such that the bushing rotates in a direction; and wherein the power transmitting member comprises;

a power transmitting gear formed at a second one of the first and second shafts to be rotated by a driving force from the driving motor, a rotary gear formed integrally with the at least one bushing at the first one of the first and second shafts to be rotatable in combination with the at least one bushing, and an idle gear having a partial tooth part that selectively transmits a rotation force of a first one of the power transmitting gear and the rotary gear to a second one of the power transmitting gear and the rotary gear when the first one of the power transmitting gear and the rotary gear rotates.

12. The image forming device as claimed in claim 11, wherein:

the first roller member comprises a photoconductive medium to have an electrostatic latent image formed thereon; and the second roller member comprises a developing roller to develop the electrostatic latent image.

13. The image forming device as claimed in claim 11, wherein:

the first roller member comprises a photoconductive medium to have an electrostatic latent image formed thereon; and the second roller member comprises a charging roller to charge the photoconductive medium with a predetermined electric potential.

14. The image forming device as claimed in claim 11, wherein:

the first roller member comprises a photoconductive medium to have an electrostatic latent image formed thereon; and the second roller member comprises a transfer roller to transfer a developer image from the photoconductive medium to a print medium or to an intermediate transfer medium.

15. The image forming device as claimed in claim 11, wherein the at least one spacing part further comprises:

a first spacing part to space first end portions of the first and second shafts apart from each other by the predetermined gap; and a second spacing part to space second end portions of the first and second shafts apart from each other by the predetermined gap.

16. The image forming device as claimed in claim 11, wherein:

the housing comprises a fixing hole; and the bushing member further comprises at least one hook member to lock the at least one bushing onto one side edge of the fixing hole.

17. The image forming device as claimed in claim 11, wherein the stopping member comprises:

a first stopping protrusion disposed on the housing to restrict a first directional movement of the lever; and a second stopping protrusion disposed on the housing to restrict a second directional movement of the lever opposite to the first directional movement.

18. The image forming device as claimed in claim 17, wherein the at least one spacing part further comprises:

a position holding member disposed at the housing to hold the lever such that the bushing is in a first position to bring the first and the second roller members into contact with each other or a second position to space the first and the second roller members apart from each other by the predetermined gap.

19. The image forming device as claimed in claim 18, wherein the position holding member comprises a position holding protrusion disposed on the housing between the first and the second stopping protrusions of the stopping member, the position holding protrusion being elastically movable by an external force or by the lever between an up-position, where the position holding protrusion is located within a moving path of the lever, and a down-position, where the position holding protrusion is located outside of the moving path of the lever.

20. The image forming device as claimed in claim 11, wherein the partial tooth part is formed such that the rotation force of the first one of the power transmitting gear and the rotary gear is transmitted within the operation range of the bushing restricted by the stopping member to the second one of the power transmitting gear and the rotary gear.

21. A process cartridge usable with an image forming device, the process cartridge comprising:

a frame;

a first roller having a first shaft extending between sides of the frame a second roller having a second shaft extending between the sides of the frame;

a spacing unit having a first spacing part disposed on the frame at first ends of the first and second shafts to space the first ends apart and a second spacing part disposed on the frame at second ends of the first and second shafts to space the second ends apart;

a first gear having first teeth and being disposed on the first end of the first shaft to be rotatable therewith;

a second gear having second teeth and being disposed on the first end of the second shaft to be rotatable therewith; and an idle gear disposed between the first and second gears and having partial teeth movable between a first position to engage the first and second teeth such that the first and second rollers are spaced apart by a predetermined gap and a second position to engage one of the first and second teeth such that the first and second rollers contact each other.

22. The process cartridge as claimed in claim 21, wherein the idle gear is initially set to the first position and is moved to the second position when the process cartridge is initially used in the image forming device.

23. The process cartridge as claimed in claim 21, further comprising:

a lever rotatably connected to one of the first and second gears through the frame such that the lever is rotated to move the idle gear between the first and second positions.

24. The process cartridge as claimed in claim 23, further comprising:

a stopping member to define a rotation range of the lever with respect to the frame such that the idle gear is not rotated beyond the first and second positions.

25. The process cartridge as claimed in claim 23, wherein the lever is rotated between first and second lever positions corresponding to the first and second positions of the idle gear, and the process cartridge further comprises:

a position holding member extending from the frame to hold a position of the lever when the lever is the second lever position.

26. The process cartridge as claimed in claim 23, further comprising:

a bushing disposed in the frame to rotatably connect the lever with the one of the first and second gears such that the one of the first and second gears is rotatable by the lever and the lever is rotatable by the one of the first and second gears.

27. The process cartridge as claimed in claim 21, further comprising:

a first gear disposed on the first end of the first shaft to be rotatable therewith a second gear disposed on the first end of the second shaft to be rotatable therewith; and a lever rotatably connected to one of the first and second gears through the frame such that the lever is rotated between first and second positions.

28. The process cartridge as claimed in claim 27, wherein when the lever is in the first position, the first and second rollers are spaced apart by a predetermined gap, and when the lever is in the second position, the first and second rollers are in contact with each other.

* * * * *

UNITED STATES PATENT AND TRADEMARK OFFICE

CERTIFICATE OF CORRECTION

PATENT NO. : 7,643,774 B2
APPLICATION NO. : 11/550848
DATED : January 5, 2010
INVENTOR(S) : Dong-hyuk Choi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 542 days.

Signed and Sealed this

Twenty-first Day of December, 2010

David J. Kappos

David J. Kappos
*Director of the United States Patent and Trademark Office*